United States Patent [19]

Hayes

[11] Patent Number: 4,533,980

[45] Date of Patent: Aug. 6, 1985

[54] LUMINOUS GUN SIGHTING SYSTEM

[76] Inventor: Lawrence S. Hayes, 263 Gates St., Andover, Ohio 44003

[21] Appl. No.: 390,691

[22] Filed: Jun. 21, 1982

[51] Int. Cl.[3] ..... F41G 1/34

[52] U.S. Cl. ..... 362/110; 362/157; 362/251; 362/800; 42/1 A; 33/241; 350/315

[58] Field of Search ..... 362/109, 110, 111, 112, 362/113, 114, 157, 190, 234, 251, 800; 42/1 A; 33/241; 350/315

[56] References Cited

U.S. PATENT DOCUMENTS

| | | | |
|---|---|---|---|
| 1,610,002 | 12/1926 | Hise | 362/110 |
| 2,268,056 | 12/1941 | Nelson | 362/112 |
| 2,442,506 | 6/1948 | Morris | 350/315 |
| 2,450,584 | 10/1948 | Dodge | 362/114 |
| 2,657,303 | 10/1953 | Dickens | 362/110 |
| 3,377,427 | 4/1968 | Fischer | 350/315 |
| 3,678,590 | 7/1972 | Hayward | 42/1 A |
| 3,833,799 | 9/1974 | Audet | 362/800 |
| 3,867,764 | 2/1975 | Dunmire | 42/1 A |
| 3,914,873 | 10/1975 | Elliot | 33/241 |
| 3,974,585 | 8/1976 | Dunham | 33/241 |
| 3,994,072 | 11/1976 | Agnello | 33/241 |
| 4,000,403 | 12/1976 | Rise | 362/110 |

FOREIGN PATENT DOCUMENTS

| | | | |
|---|---|---|---|
| 493420 | 5/1950 | Belgium | 42/1 A |
| 147408 | 4/1981 | German Democratic Rep. | 33/241 |
| 22939 | of 1914 | United Kingdom | 362/110 |
| 1385085 | 2/1975 | United Kingdom | 362/110 |

*Primary Examiner*—Craig R. Feinberg
*Assistant Examiner*—David A. Okonsky
*Attorney, Agent, or Firm*—Watts, Hoffmann, Fisher & Heinke Co.

[57] ABSTRACT

A luminous gun sighting system for use with a conventional firearm for hunting nocturnal prey includes a light source mounted on the firearm. The light source has an opening for emitting light therefrom along a path. A power supply is provided for powering the light source. A circuit means is provided for selectively connecting and disconnecting the power supply and the light source. A lens assembly is positioned adjacent to the light emitting opening of the light source and has a colored lens which is movable between a closed position and an open position. In the closed position, the colored lens is positioned across the path of light emitted from the light source and in the opened position the colored lens is clear of the path of light emitting from the light source. The luminous gun sighting system also includes means for moving the lens assembly between the open and closed position. Front and rear gun sights are also provided which may be selectively lighted for use during low to non-existent ambient light conditions.

18 Claims, 23 Drawing Figures

FIG 1
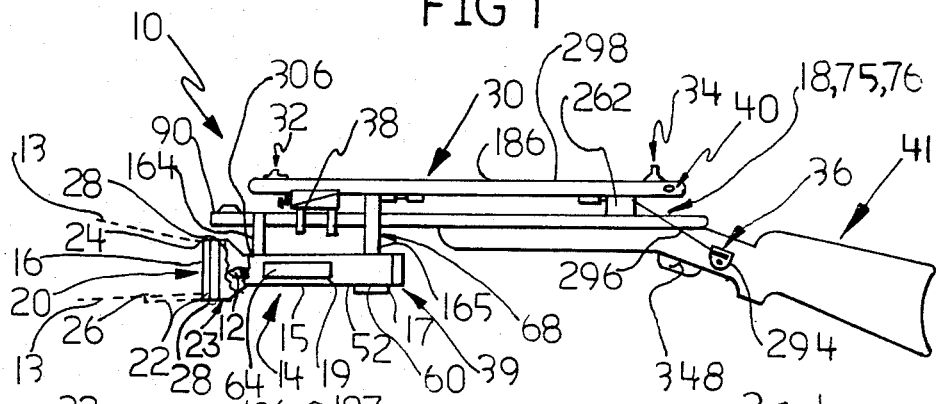
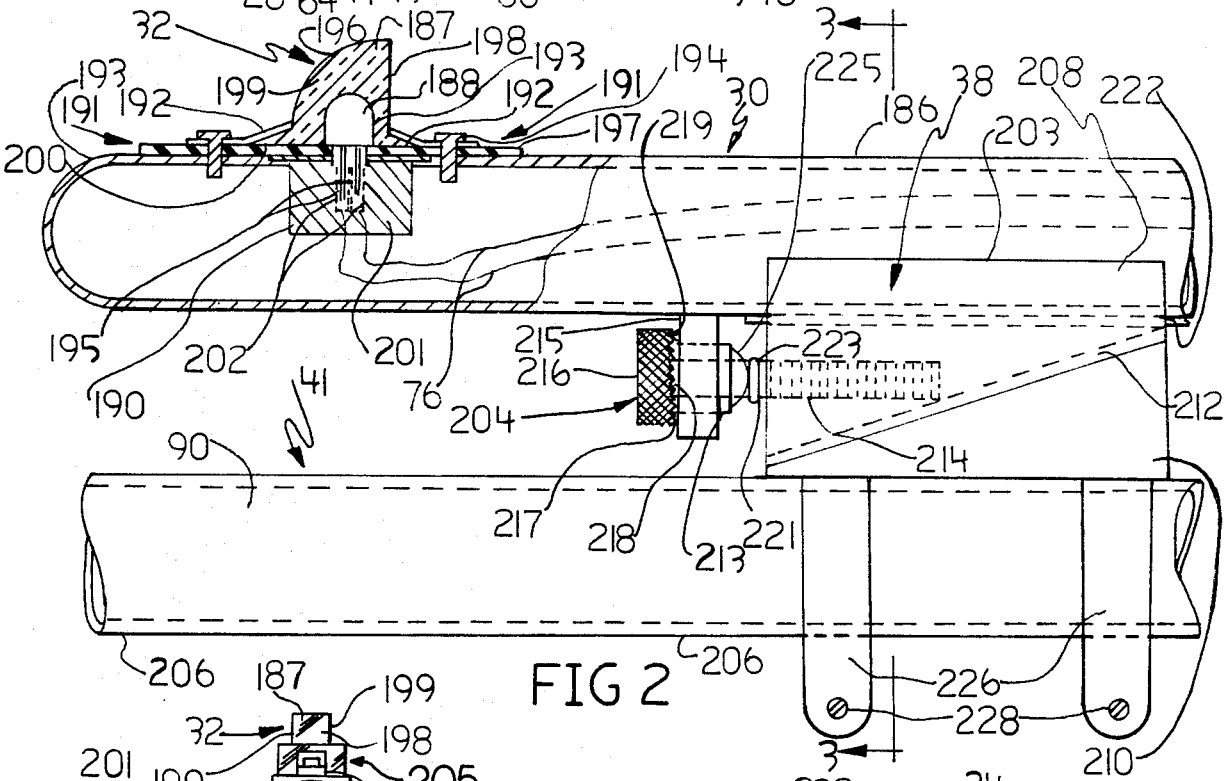
FIG 2
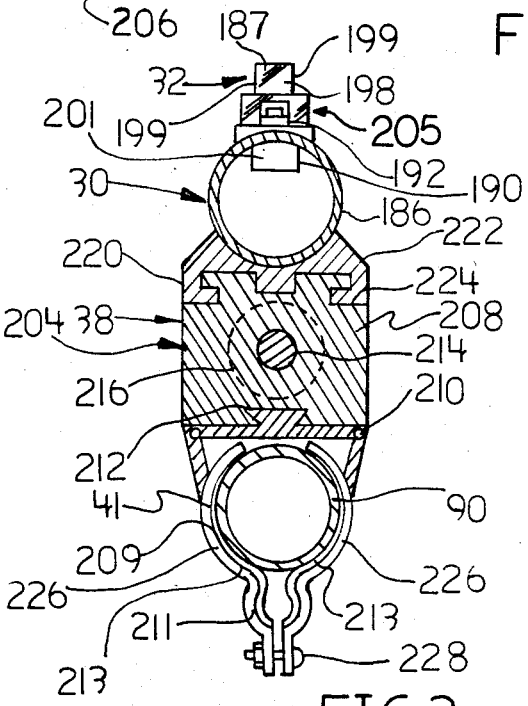
FIG 3
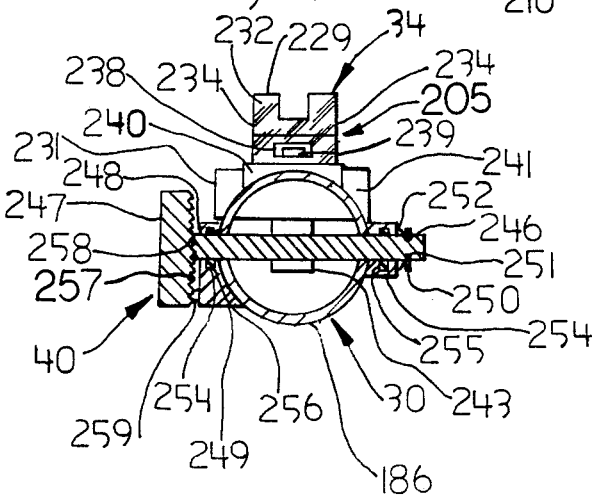
FIG 5

FIG 12
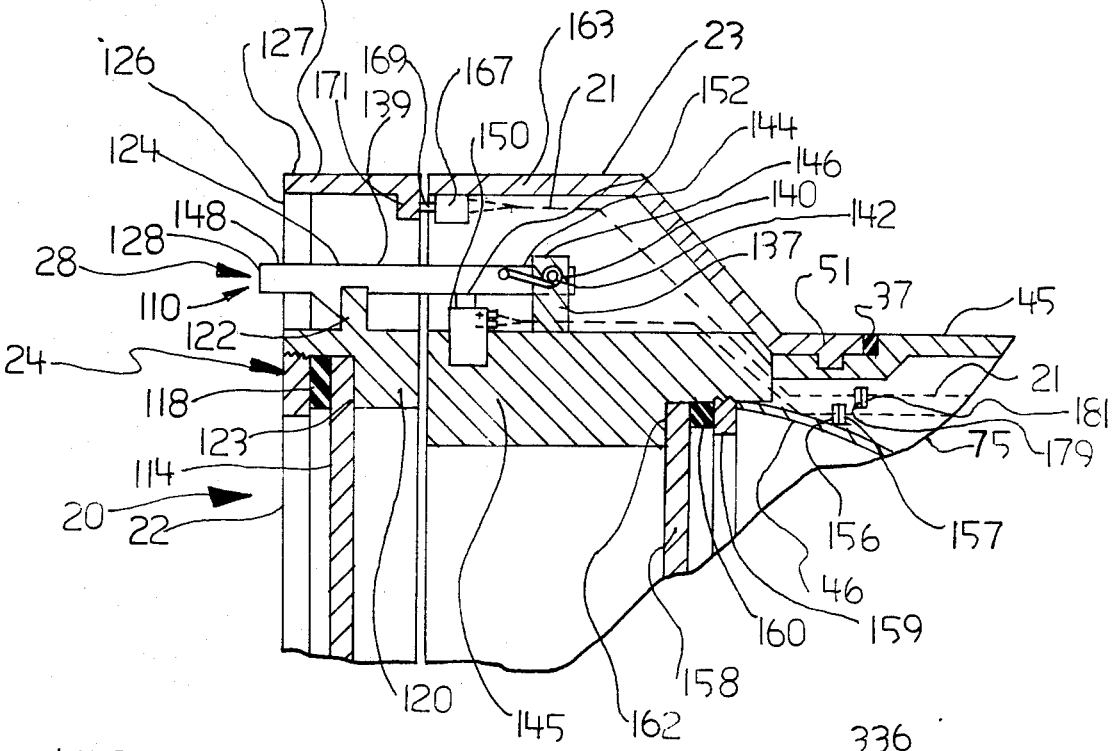
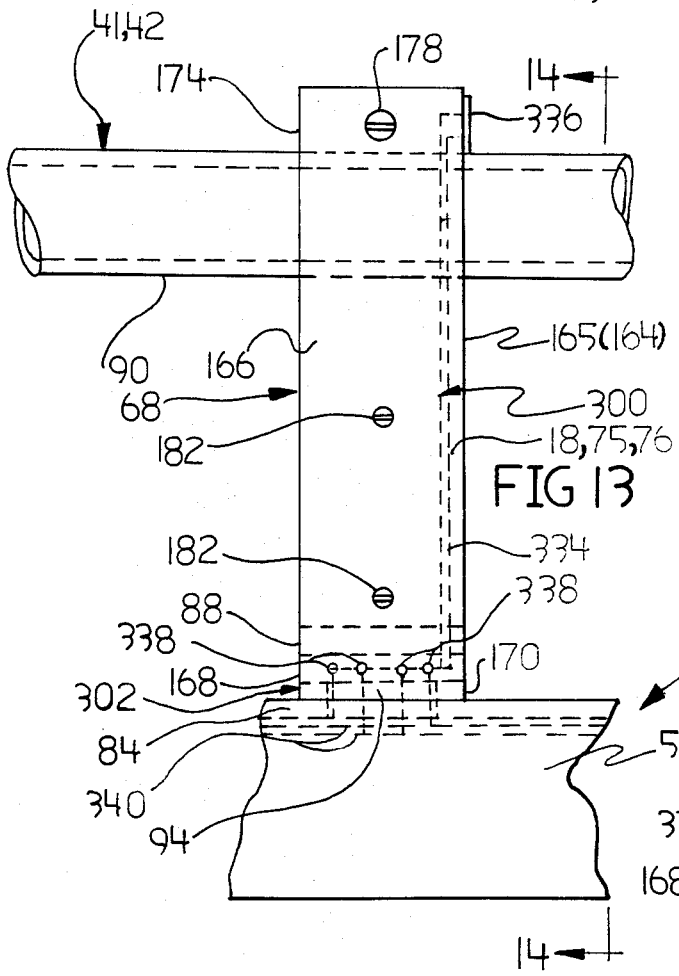
FIG 13
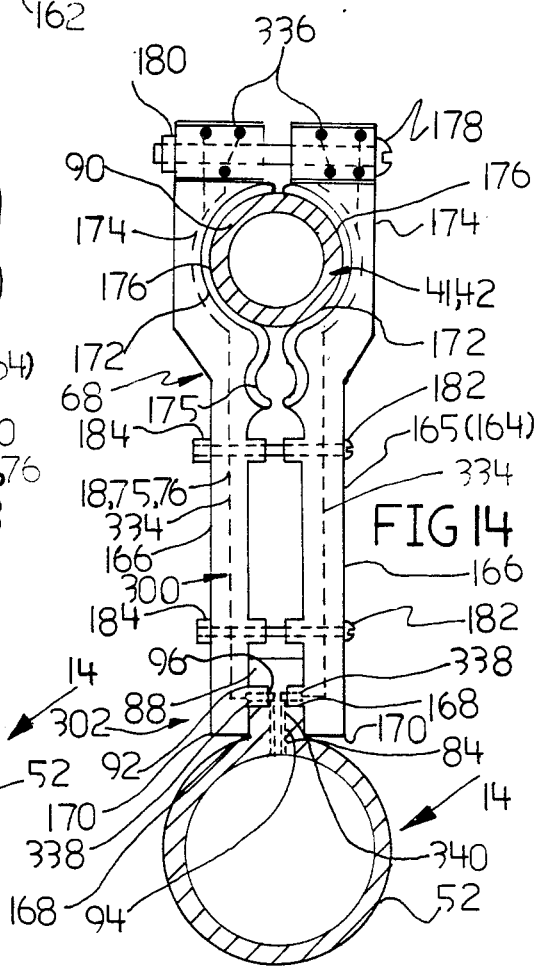
FIG 14

FIG 18
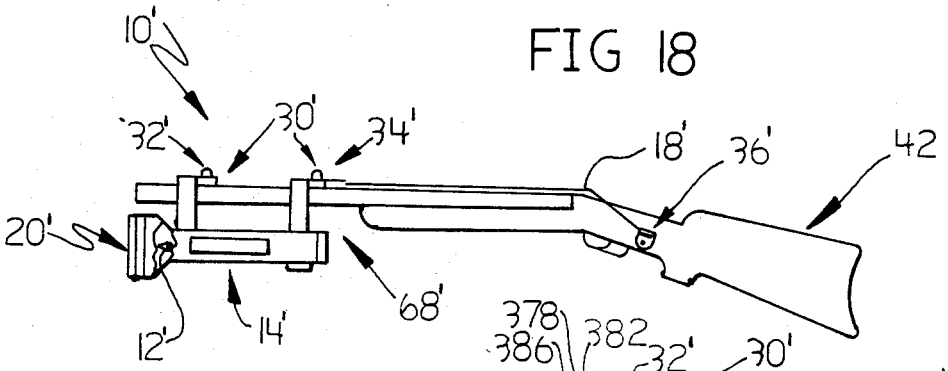
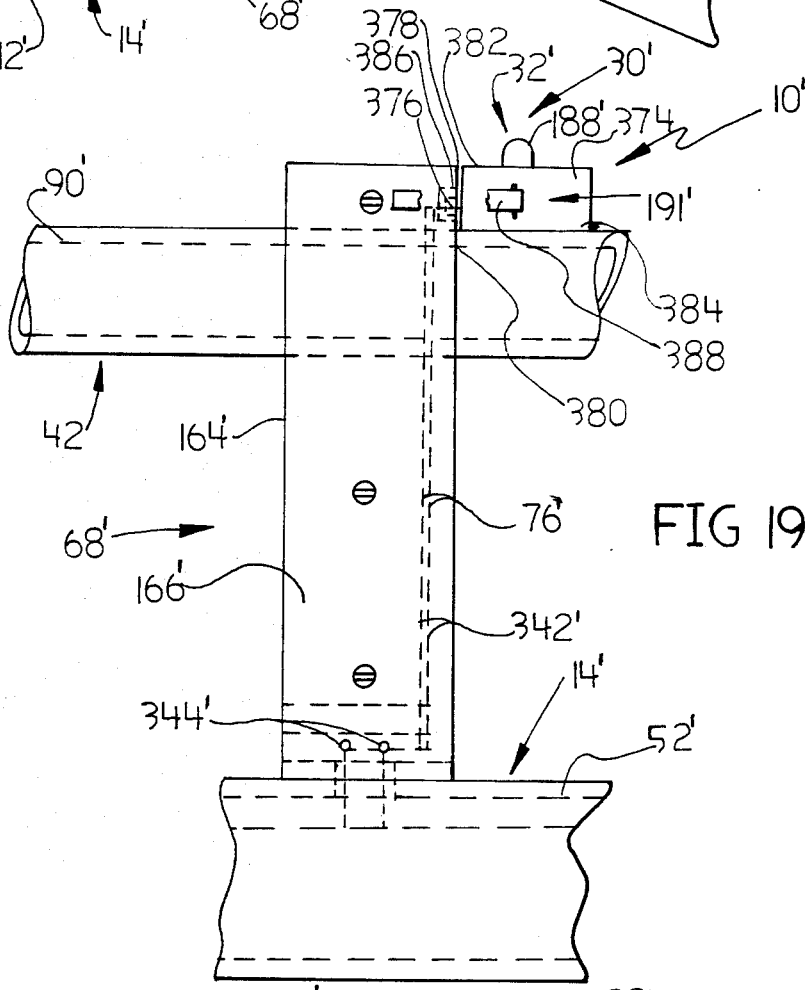
FIG 19
FIG 20
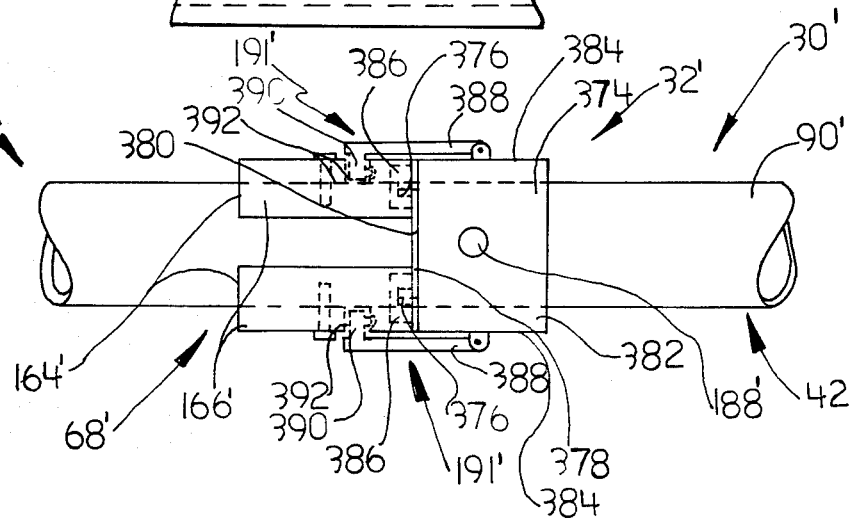

LUMINOUS GUN SIGHTING SYSTEM

BACKGROUND OF THE INVENTION

This invention relates generally to gun sights and more particularly to a gun sighting system useful for hunting wild game at night or in low or non-existent ambient light conditions.

Heretofore, various illuminating means for firearms, such as flash or flood lights, have generally been attached to either the barrel or stock of the weapon so that the target sought by the marksman may be more readily seen. These devices have been used by the police or military against human targets wherein a bright, clear light source is required under dark or near dark sighting conditions. Exemplary of such is the search light device disclosed in U.S. Pat. No. 4,069,414,such device as used with revolvers as shown in U.S. Pat. Nos. 1,150,796 and 1,149,705, and the flashlight attachment for a Thompson sub-machine gun disclosed in U.S. Pat. No. 2,597,565.

While the known flashlight devices attached to revolvers or rifles may be effective for their intended purposes, namely quickly locating targets, they have inherent shortcomings when hunting nocturnal prey since wild animals are quickly alerted to the bright, clear light source and will run for cover. It is desirable to emit a colored light from a luminous sighting system to decrease the chances of frightening the hunted prey.

It is also desirable to visually align the front and rear iron sights of a weapon under low or non-existent ambient light conditions. In order to overcome this sighting deficiency, various attempts have been made to provide low ambient light sighting systems which employ various arrangements, such as the luminous reticle utilized in a scope disclosed in U.S. Pat. No. 3,320,671, a lighted bead sight shown in U.S. Pat. No. 3,994,072, a sight lighting device disclosed in U.S. Pat. No. 3,883,799, a front and rear sight lighting device as shown in U.S. Pat. No. 3,678,590, luminescent sight blocks on a tube as shown in U.S. Pat. No. 3,294,963, the luminated sights in a tube shown in U.S. Pat. No. 3,820,248, and illuminated sights on a pistol as shown in U.S. Pat. No. 3,914,873. The known illuminated sighting systems have various inherent shortcomings including, the need for some ambient light for their operation, the absence of both an illuminated front and rear sight, the absence of adjustment means to compensate for windage and trajectory, and the absence of intensity adjustment means for illuminated rear sights. For example, the front sight lighting device disclosed in U.S. Pat. No. 3,833,799 utilizes a photosensitive transistor which must receive available light rays to activate appropriate circuitry and illuminate the sight light. The intensity of the light emitting from the front gun sight increases when the amount of ambient light increases, and alternately, the output of light decreases when the amount of ambient light decreases. In the absence of any ambient light, it would be difficult, if not impossible, to discern the unlighted rear gun sight when using that device.

Hunting in low or non-existent ambient light normally requires two or more people—one or more to shoot the prey and one or more to spot the prey with a flashlight. It is desirable to mount a floodlight and illuminated sights to a firearm to facilitate hunting in low or non-existent light by one or more persons.

Thus, these known devices are not suitable for hunting wild game at night since they either emit a bright, clear light beam which will frighten the prey, require some ambient light in order to illuminate the sights, which, necessarily, renders them unsuitable when hunting in complete darkness, fail to provide illuminated front and rear sights, fail to provide positional adjustment means, fail to provide intensity adjustment means for the rear sight light sources, or fail to provide a complete night hunting system operable by one person.

SUMMARY OF THE PRESENT INVENTION

The present invention provides a new and improved luminous gun sighting system for hunting nocturnal prey under conditions of low or non-existent ambient light having certain advantageous features.

The present invention provides a luminous gun sighting system having lighted front and rear gun sights which emit light only in a rearward direction. This result is achieved by finishing the faces of the front and rear gun sights, except for the rearward face which is visible to the hunter, in such a way so as to reflect light towards the rearward face and maximize the amount of light passing through the rearward face. In addition, such finishing of the faces minimizes any light emanating from the front and rear gun sights, other than in the rearward direction, which results in maximizing the definition of the front and rear gun sight to the hunter and minimizing the risk of alerting and scaring away the hunted prey.

The intensity of light emanating from the rear sight is adjustable to accommodate the particular hunter using the gun sighting system of the present invention and further provide for a hunter to have a clearly defined front and rear gun sight. The position of the lighted front and rear gun sights are independently adjustable to provide accurate sighting thereof.

The present invention further provides a floodlight and integral battery case attached to the firearm which includes a red lens assembly to provide a visible, filtered red light of adjustable intensity yielding ample background illumination for the marksman to locate the game, while, at the same time, minimizing the risk of frightening the prey.

The present invention further provides an illuminated sighting system which includes a remotely activated solenoid for promptly removing the red lens from the floodlight source and converting the same to a bright, clear floodlight beam for locating the animal after it has been shot or for any other reason deemed necessary by the hunter.

The present invention still further provides a luminous gun sighting system which includes a compact battery case and circuitry for energizing the upper lighted gun sights, the lens opening solenoid and the floodlight.

Switches for selectively energizing the upper gun sights, the floodlight or the lens opening solenoid are conveniently located adjacent to the trigger of the firearm for easy and instant operation. These switches allow the hunter to locate an animal's eyes by use of the red lens and red light beam emitted therefrom while aiming the firearm at the animal's head. Then, without changing the aim of the firearm, the hunter may activate the switch which operates to activate the opening solenoid so that the entire animal is illuminated without changing his aim. Even though the animal may instantly move for cover, the hunter will already have the firearm aimed at the animal thus minimizing the animal's chances of escape.

Briefly, the luminous gun sighting system of the present invention achieves the above-mentioned desirable features by providing an adjustable upper sighting assembly tube having front and rear gun sights attached thereto. The gun sights are constructed of a light transmitting material, such as light transmitting plastic, and are illuminated so as to emit a red light when activated. The use of red light in conjunction with the sights allows the hunter to maintain good night vision while allowing him to readily see the sights, and will not frighten the prey. The sights are designed to permit the light to pass only through the rear surfaces thereof in the direction of the hunter. Light sources are provided within the upper sighting assembly tube for illuminating the front and rear sights. Mounted beneath the firearm is a floodlight and battery case. Light emitting diodes may also be similarly used as will be herein described.

The lens assembly carried by the floodlight comprises an innermost clear lens and a pivotally mounted red filter lens. A red, filtered light is particularly suitable for hunting nocturnal game in that red light tends to go unnoticed by the prey while still permitting the hunter to see the target.

While the red light will fully illuminate the entire target, it will do so to a lesser degree than a bright, clear floodlight except in the case of the animal's eyes. With the red light, the animal's eyes will shine brilliantly while the animal itself may or may not be visible. The distance from which the entire animal may be visible depends on the intensity of the red light. However, due to the accuracy of the illuminated sight of the present invention, the entire animal need not be visible and only the eyes of the animal need be visible in order to make a clean killing shot.

The lens assembly may be promptly moved from a closed position to an open position so that a bright floodlight is provided. This change in position of the lens assembly occurs upon activation of a solenoid which causes the red filter lens to spring away from the light source thus permitting the light to pass only through the clear lens. The red filter lens may also be manually moved from a closed position to an open position.

In the case in which the intensity of the adjustable red light is adjusted to a low intensity, the present invention provides a bypass circuit so that when the red lens assembly is moved from the closed position to the open position, the intensity of the bright floodlight is automatically operated at full power so that the maximum illumination of the floodlight is available to better illuminate the prey.

Batteries for energizing the floodlight, solenoid and upper front and rear gun sights are mounted within the battery case with appropriate circuitry running from the battery case through its mounting bracket to the upper gun sighting assembly and thence rearwardly to the light and solenoid switches in a compact and waterproof assembly.

Within the battery case, shock absorbers are positioned between adjacent batteries and between the light source and the forwardmost battery which serve to protect the batteries and the light source from the compressive forces generated by the recoil of the firearm.

BRIEF DESCRIPTION OF THE DRAWINGS

In the drawings:

FIG. 1 is a side elevational view of the present invention mounted on a conventional firearm;

FIG. 2 is an enlarged, partial cross-sectional side view of the front, lighted gun sight mounted to the barrel of a conventional firearm shown in FIG. 1;

FIG. 3 is a cross-sectional view taken along line 3—3 of FIG. 2;

FIG. 5 is a cross-sectional view taken along line 5—5 of FIG. 4;

FIG. 12 is a partial cross-sectional side view of the lens assembly carried by the floodlight shown in FIG. 1;

FIG. 13 is a partial, side elevational view of the floodlight and battery case assembly mounted to the barrel of a conventional firearm;

FIG. 14 is a partial, cross-sectional view taken along line 14—14 of FIG. 13;

FIG. 18 is a side elevational view of another embodiment of the present invention mounted on a shotgun;

FIG. 19 is a partial, side elevational view of the floodlight and battery case assembly and the front lighted gun sight mounted to the barrel of a shotgun shown in FIG. 18;

FIG. 20 is a top view of the front lighted gun sight mounted to the barrel of a shotgun shown in FIG. 18;

DETAILED DESCRIPTION OF THE INVENTION

Figure 4:
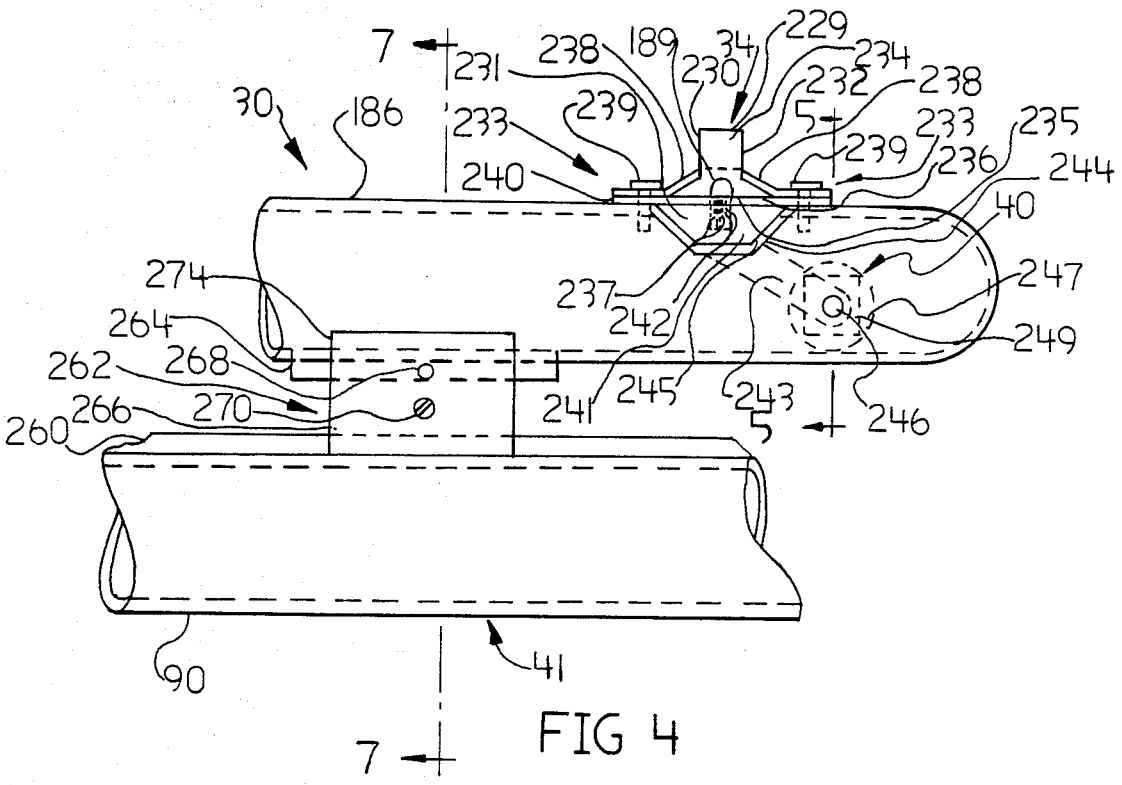
FIG. 4 is an enlarged, partial side elevational view of the rear, lighted gun sight mounted to the barrel of a conventional firearm shown in FIG. 1.

Referring now more specifically to the drawings, and in particular FIG. 1, a luminous gun sighting system 10 embodying the features of the present invention is shown for hunting nocturnal prey under conditions of low or non-existent ambient light as exist at night. It should be understood that it is within the contemplation of this invention that the system 10 be adaptable to both rifles and shotguns. FIGS. 1–7, 13–15, and 17 show the system 10 as used with a rifle 41, and FIGS. 18–23 show it as used with a shotgun 42. FIGS. 8–12 and 16 show the components of the system 10 that are used with either type of firearm. The luminous gun sighting system 10 shown in FIG. 1 includes a light source or floodlight 12 and a power supply 14. The floodlight 12 has an opening 16 for emitting light therefrom along a path 13 when the power supply 14 is connected to the floodlight. The luminous gun sighting system 10 also includes a circuit means 18 and a lens assembly 20. The circuit means 18 is provided for selectively connecting and disconnecting the power supply 14 and the floodlight 12.

Figure 8:
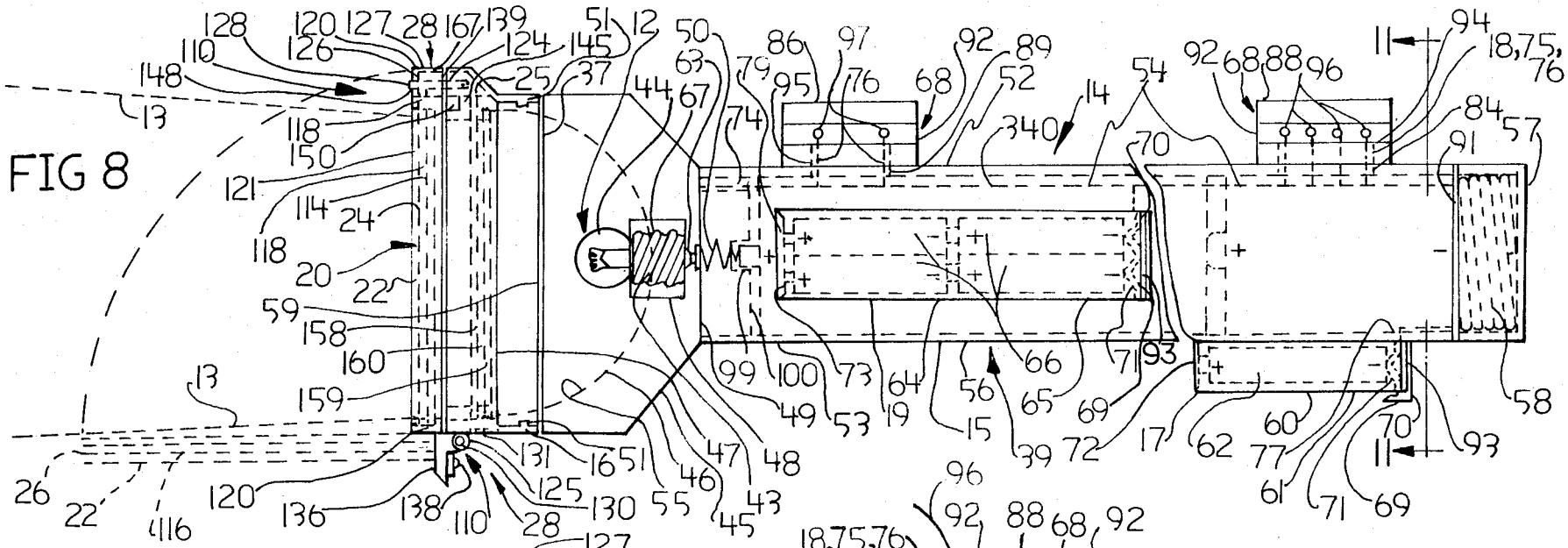
FIG. 8 is a side elevational view in fragmentary form of the floodlight and battery case assembly shown in FIG. 1.

The lens assembly 20 is positioned adjacent to the light emitting opening 16 of the floodlight 12 and includes a colored lens assembly 22 and a clear lens assembly 23. The clear lens assembly 23 is positioned across the path 13 between the floodlight 12 and the colored lens assembly 22. The colored lens assembly 22 is movable between a closed position, indicated at 24 in FIGS. 1 and 8, and an opened position, indicated at 26. In the closed position 24, the colored lens assembly 20 is positioned across the path 13 of light emitting from the floodlight 12 and in the opened position 26, the colored lens assembly is clear of the path of light emitting from the floodlight. Means 28 are provided for selectively moving the colored lens assembly 22 between the closed and opened positions, 24, 26 respectively. The colored lens assembly 22 is shown in FIGS. 1 and 8 in the closed position 24 with the open position 26 shown in dashed lines.

The floodlight 12, power supply 14, circuit means 18, and lens assembly 20 shown in FIG. 1 cooperate to provide a visible, filtered colored light of adjustable intensity yielding ample background illumination for a hunter to locate the prey, while, at the same time, minimizing the risk of frightening the prey. These components are also capable of changing the beam of colored light to a bright clear floodlight beam for locating the prey after it has been shot or for any other reason deemed necessary by the hunter.

The luminous gun sighting system 10 of the present invention also includes a sight means 30 for sighting prey during both the day and night. The sight means 30 includes a front and a rear sight, 32, 34 respectively, means 36 for selectively illuminating the front and rear sights, and means 38 and 40 for adjusting the physical position of the front and rear sights, respectively.

In the embodiment of the present invention shown in FIG. 1, the floodlight 12 is shown as it would appear when mounted with the power supply 14 on a conventional firearm, such as a rifle 41. It should be understood that it is within the contemplation of the present invention to provide a luminous gun sighting system as herein described on any other firearm.

As shown in FIG. 8, the floodlight 12 includes a conventional high intensity light emitting element 44, such as a commercial light bulb or the like, a light reflector 46 having the light emitting opening 16, and a means 48 for securing the light emitting element to the light reflector.

The reflector 46 is optically shaped to maximize the intensity of the beam of light emitted therefrom and has a reflective inner surface 55. At the apex of the optically shaped reflector 46, an opening 43 is provided for mounting the light bulb 44 therein by any conventional means known to those skilled in the art, such as by threading, using a keyed connection or the like.

It is well known that commercial light bulbs have two electrical contacts. One contact 63 of the light bulb 44 is connected to a contact 50 which is contained within a shock absorber 74 mounted at the front end 53 of a battery case 52 as will be hereinafter more fully described. The contact 50 has a spring like shape and is positioned to electrically connect the contact 63 of the light bulb 44 and a power supply 15 as herein more fully described. The other contact 67 of the light bulb 44 is connected to an electrical pickup, such as an electrically conductive reflector 46. The reflective inner surface 55 of the reflector 46 focuses the light emitted from the light bulb 44 along a path, indicated by the dashed lines 13, through the opening 16.

The floodlight 12 also includes a case 45 to which the reflector 46 is secured by any conventional means known to those skilled in the art. An interfitting lugged connection 51 is provided on the front end 47 of the light source case 45 and the rear end 59 of the lens assembly 20 to allow for removable attachment of the lens assembly 20. The connection 51 includes a rubber gasket 37 which provides a watertight connection between the lens assembly 20 and the case 45. It should be understood that it is within the contemplation of the present invention to provide any other means of interconnecting the lens assembly 20 and the case 45.

The rear end 49 of the floodlight case 45 is attached to the front end 53 of the battery case 52 by any conventional means known to those skilled in the art and may even be formed as a single piece.

The power supply 14 shown in FIGS. 1, 8, 11, and 17 includes three separate power supplies 15, 17, and 19 in a battery pack 39 but it should be understood that it is within the contemplation of this invention to use any available power supply arrangement. The power supply 15 powers the floodlight 12. The power supply 17 powers the means 28 for selectively moving the colored lens assembly 22. The power supply 19 powers the means 36 for selectively illuminating the front and rear sights 32, 34 respectively.

The battery pack 39 includes the battery case 52 and and batteries 54 of the power supply 15. The batteries 54, shown in FIG. 8, 11, 16, and 17, are four "D" size, 1.5 volt batteries arranged in series so that the positive end of one battery abuts the negative end of an adjacent battery. The forwardmost battery 54 is in electrical contact with the contact 50 in the shock absorber 74. It should be understood that it is within the contemplation of this invention to use any available batteries and power supply means which meet the voltage and power requirements of the device powered thereby.

Figure 11:
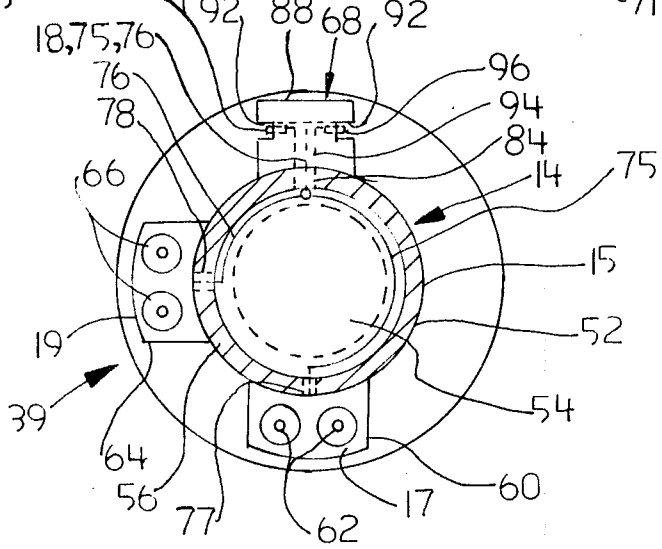
FIG. 11 is a cross-sectional view taken along line 11—11 of FIG. 8.
Figure 17:
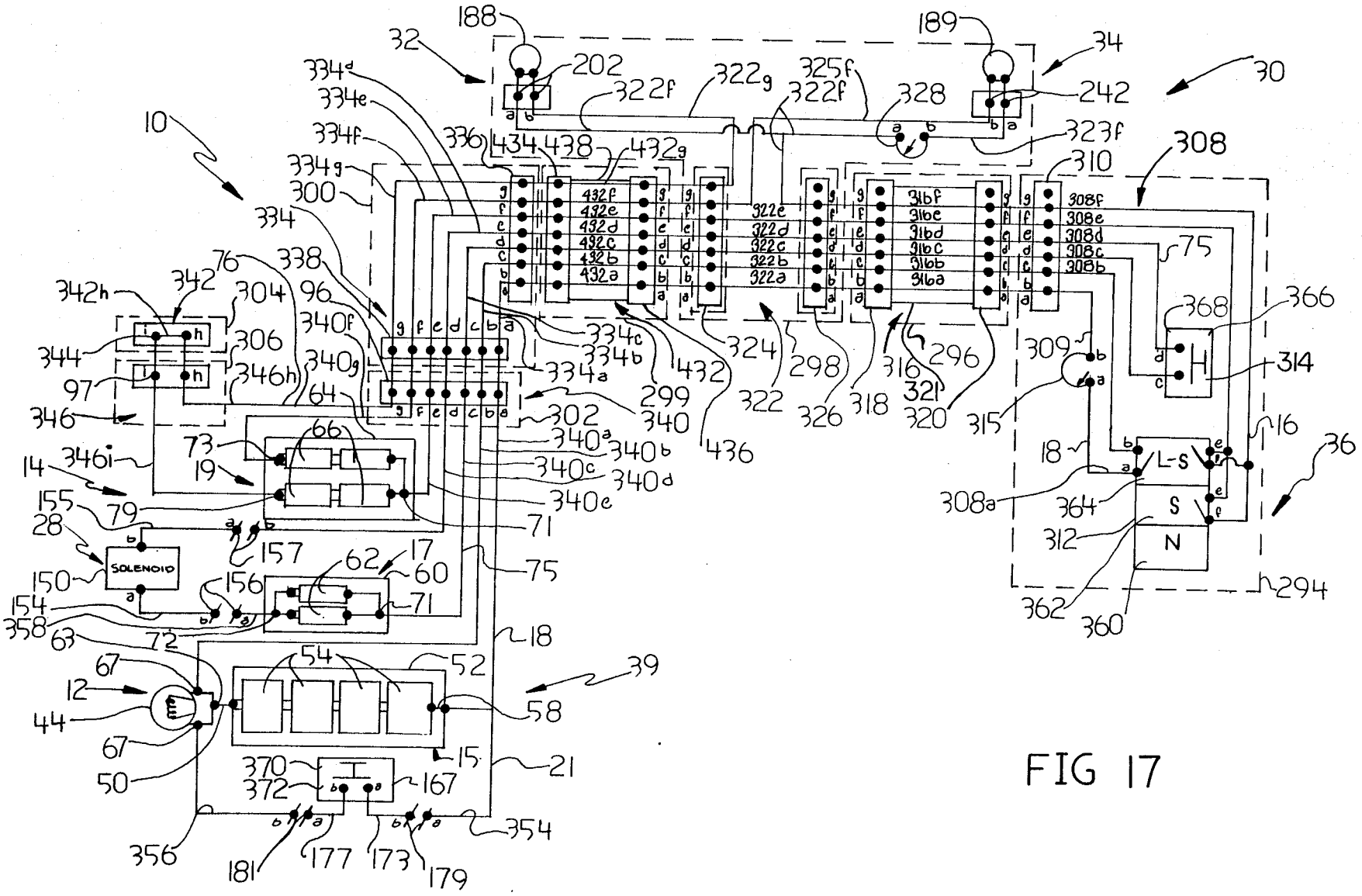
FIG. 17 is a schematic drawing illustrating the electrical circuitry of the present invention.

The battery pack 39 also includes an auxiliary battery case 60 for holding the batteries 62 of the power supply 17, another auxiliary battery case 64 for holding the batteries 66 of the power supply 19, and a means 68 for mounting the battery pack to the rifle 41. The batteries 62 and 66, shown in FIGS. 8, 11, and 17, are respectively two and four "AA" size, 1.5 volt batteries, but it should be understood that it is within the contemplation of this invention to use any available batteries and power supply means which meet the voltage and power requirements of the device powered thereby. The two batteries 62 are arranged in a side by side pair with both positive ends facing the same direction. The four batteries 66 are arranged in two adjacent pairs, each pair being two batteries arranged such that the positive end of one battery abuts the negative end of the other.

The battery case 52, including the battery cases 60 and 64, are preferably constructed of a shock resistant, plastic material. The battery case 52 includes a body member 56, a threadably removable end cap 57 attached thereto, the shock absorber 74, and shock absorbers 98 as herein more fully described. A rear contact spring 58 is housed in the end cap 57. The contact spring 58, shown in FIGS. 8 and 17, electrically contacts the rear battery 54 and urges the batteries 54 against the electrical spring contact 50 which electrically contacts the forwardmost battery 54. A rubber gasket 91 is provided in the end cap 57 to provide a watertight connection between the cap and the case 52.

The battery cases 60 and 64, shown in FIG. 8, include removable end caps 69 which resiliently snap onto the open ends 70 of the body members 61 and 65, respectively. The end caps 69 each include flexible spring contacts 71 and rubber gaskets 93. The spring contacts 71 urge the batteries 62 and 66 forward in the cases 60 and 64, respectively, so that the positive ends of the forwardmost batteries touch the front contact 72 in the case 60 and the contacts 73 and 79 in the case 64, respectively. The gaskets 93 provide a watertight connection between the caps 69 and the cases 60 and 64.

As shown in FIGS. 1, 8, 11, 12, 13, 15, and 17, the luminous gun sighting system 10 includes a circuit means 75 for selectively moving the colored lens assembly 22 between an open and closed position 26, 24 respectively. The luminous gun sighting system 10 also includes a circuit means 76 for selectively connecting and disconnecting power to selectively illuminate the front and rear sights 32, 34 respectively. The battery case 52, shown in FIG. 11, contains wiring slots 77 and 78 which extend through the wall thereof and communicate with the interiors of the battery cases 60 and 64, respectively. As will be hereinafter described, some of the wiring of the circuit means 75 and 76 is routed through the slots 77, 78 in the battery case 52 and through the slot 84 which extends through the wall of the battery case adjacent to the mounting means 68.

The mounting means 68, shown in FIGS. 1, 8, 11, and 15, serves both as a means for securing the battery pack 39 to the firearm 41 and as a conduit for a portion of the circuit means 18, 75, and 76 as will be hereinafter more fully described. As shown in FIG. 8, the mounting means 68 includes a front and a rear mounting bracket 86, 88 respectively, which are attached to the battery case 52. The brackets 86 and 88 are similar in construction and are adapted to engage the clamps 164, 165 respectively, (FIGS. 13 and 14) which are attached to the gun barrel 90.

As can be seen in FIG. 11, the rear mounting bracket 88 contains two opposed mounting grooves 92 as well as a wiring slot 94 which is positioned adjacent to the wiring slot 84. Part of the wiring for the circuit means 18, 75, and 76 passes through the slots 84, 94 and is connected to the electrical contact pins 96 mounted within the mounting grooves 92 as will be hereinafter more fully described. The electrical contact pins 96 include seven pins and for ease of description, these pins will be hereinafter referred to as pins 96*a*, 96*b*, 96*c*, 96*d*, 96*e*, 96*f* and 96*g*, as seen in FIG. 17.

The front mounting bracket 86, shown in FIG. 8, is constructed similar to the rear mounting bracket 88 with two opposed mounting grooves 92 and a wiring slot 95 which is positioned adjacent to the wiring slot 89. Part of the wiring of the circuit means 76 passes through the slots 89 and 94 and is connected to the electrical contact pins 97 mounted within the mounting grooves 92 as will be hereinafter more fully described. The electrical contact pins 97 include two pins and for ease of description, these pins will be hereinafter referred to as pins 97*h* and 97*i* as seen in FIG. 17.

Figures 15, 16:
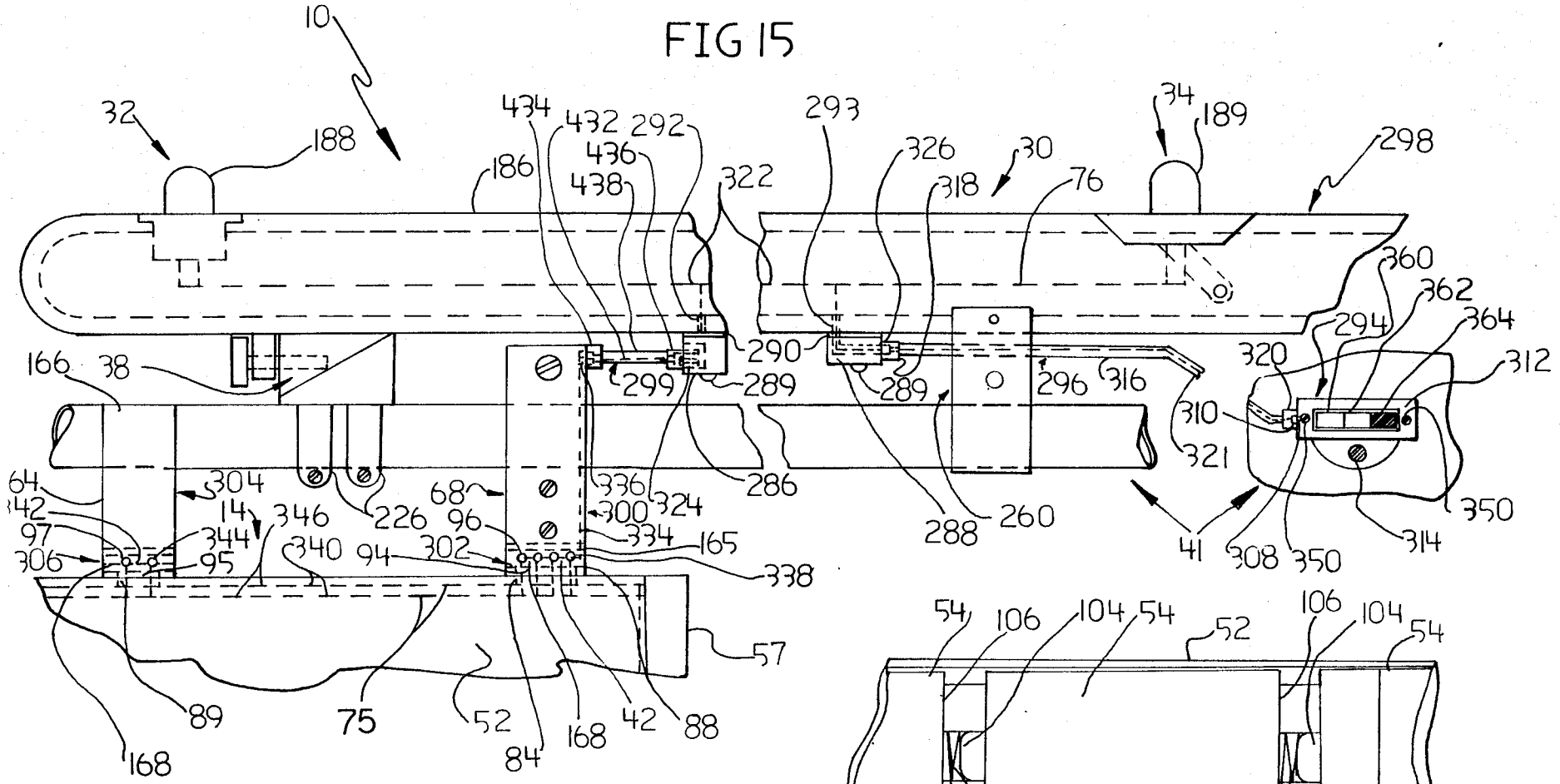
FIG. 15 is a side elevational view in fragmentary form showing the upper gun sighting assembly and floodlight mounting bracket with related wiring components and switch assembly.
FIG. 16 is a side elevational view in fragmentary form showing two of the battery shock absorbers positioned between adjacent batteries.

It is contemplated that the present invention will find its application in conjunction with firearms, such as a rifle or a shotgun. It is known that rifles and shotguns generate considerable recoil forces, particularly when the hunter is using high powered magnum shells. It is therefore desirable to protect the batteries and particularly the larger, "D" size batteries 54 and the light 44 from any compressive shock caused by the firing recoil. The shock absorber 74 shown in FIG. 8 is provided both to protect the light 44 from any compressive shock from the forwardmost battery 54 during the firing recoil, and to house the contact 50 as previously described. Referring to FIG. 16, the shock absorbers 98 are provided and are positioned between the batteries 54 in order to prevent compressive shock damage to adjacent batteries. The shock absorbers 74 and 98 are made from a resilient material, such as flexible plastic gum rubber or any other elastomeric material.

The shock absorber 74 shown in FIG. 8 has circular outer sides and has a circular recess 99 in its rear face 100. The thickness of the shock absorber 74 and the size and position of the recess 99 are determined by the dimensions of the particular batteries 54 used. The shock absorber 74 is mounted in the front end 53 of the battery case 52. As previously described, the electrical contact spring 50 is mounted in the shock absorber 74 to electrically interconnect the light 44 and the forwardmost battery 54.

The shock absorbers 98 shown in FIG. 16 have circular outer sides and have a circular opening 101 through their centers giving them a doughnut shape. The thickness of the shock absorbers 98 and the size and position of the center opening 101 are determined by the dimensions of the particular batteries 54 used. The contact springs 102 are positioned between the batteries 54 and are located in the opening 101 in the shock absorber 98. The spring 102 provides an electrical connection between adjacent batteries 54 by compressively engaging the positive contact 104 of a battery 54 at one end and the negative contact 106 of an adjacent battery 54 at its other end.

Another design of the shock absorber 98 is shown in FIG. 16 as indicated at 98'. The shock absorber 98' contains an integral thin walled cap portion 107 which is made from any resilient material, such as flexible plastic, gum rubber or any other elastomeric material. The cap portion 107 fits snugly around the end of a battery 54 at its positive contact end 104 in order to insure the proper positioning of the shock absorbers 98'within the battery case 52.

Figure 10:
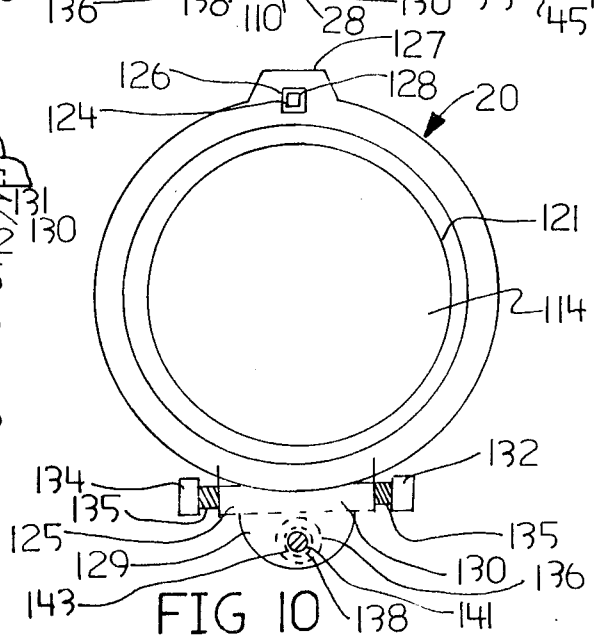
FIG. 10 is a front, elevational view of the floodlight of FIG. 8.

Referring to FIGS. 8, 10, and 12, the lens assembly 20 is shown mounted to the light source case 45 by way of the lugged connection means 51. The lens assembly 20 includes the colored lens assembly 22, the clear lens assembly 23, a means 110 for adjustably mounting the colored lens assembly, and the lug connection 51 for mounting the lens assembly to the light source case 45. This invention provides a watertight lens assembly 20 to allow use of the luminous gun sighting system 10 regardless of the presence of moisture.

The colored lens assembly 22 contains a colored lens 114. The colored lens 114 may be selected from a wide variety of colors, dependent of course on the ambient light conditions. It has been discovered that the use of a red lens which provides a red filtered light improves the visibility of an animal's eyes during the night season while not startling the animal.

In order to mount the colored lens 114 in the other colored lens assembly components, a generally circular seating lug 120 and a retainer ring 121 are provided. The seating lug 120 has a locking post 122, a ledge 123, a hollow tubular member 125, an upper tab 127 and a lower tab 129. The seating lug 120 is preferably a molded part of the colored lens assembly 22. The retainer ring 121 threadably engages the seating lug 120. When assembled, the retainer ring 121 compressively engages an 0-ring gasket 118 which exerts pressure on the colored lens 114. The pressure exerted by the gasket 118 urges the colored lens 114 against the ledge 123 to hold the colored lens in place.

In the closed position 24, the locking post 122 is engaged by a latch mechanism 124 of the lens assembly 20 and the latch mechanism is in an engaged position 148. An opening 126 is provided in the upper tab 127 to accommodate the extension 128 of the latch mechanism 124. The extension 128 is provided for manual operation of the latch mechanism 124. As herein described, the latch 124 may also be electrically operated.

Figure 9:
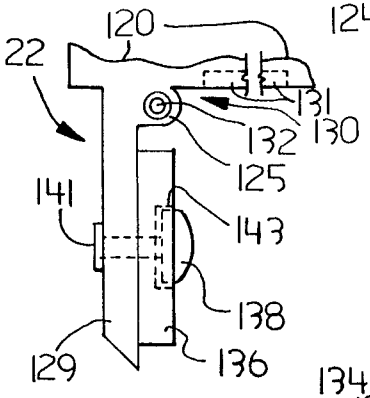
FIG. 9 is an enlarged, partial side elevational view of the lens assembly carried by the floodlight shown in FIG. 1.

The colored lens assembly 22 is pivotally mounted to the clear lens assembly 23 by the tubular member 125 on the seating lug 120, a threaded pin 132, and a nut 134 which, when assembled with the colored lens assembly 22, form a hinge 130 as shown in FIGS. 8, 9, and 10. A coil spring 135 is wrapped in torsional compression around the pin 132 and has one end secured to the tubular member 125 and the other end secured to the seating lug 120 to move the colored lens assembly 22 toward the open position 26 when the latch mechanism 124 is moved upward to a disengaged position (not shown).

To prevent damage to the colored lens assembly 22 when it is opened, a magnet 136 and a shock absorber 138 are attached to the lower tab 129 and a steel plate 131 is mounted in the seating lug 120 as shown in FIGS. 8, 9, and 10. The magnet 136 is circular in shape with a partial center circular bore 143 in which the shock absorber 138 is mounted. A screw 141 passes through the lower tab 129 into the magnet 136 to secure the magnet to the lower tab. The steel plate 131 is circular in shape and secured to the seating lug 120 by any conventional means known to those skilled in the art to come in contact with the magnet 136 and the shock absorber 138 when the colored lens assembly 22 is in the open position 26. This magnet, shock absorber, and steel plate combination suppresses the tendency of the colored lens assembly 22 to bounce when it is opened.

The latch bar 139 of the latch mechanism 124 is mounted to the clear lens assembly 23 by a mcunting post 137 and a pivot mounting pin 140 positioned through an opening 142 through the rear end 144 of the latch bar 139 as shown in FIG. 12. The mounting post 137 is mounted to a generally circular seating lug 145 of the clear lens assembly 23. The latch bar 139 is downwardly biased by a spring 146 which rides on the pin 140 to maintain the latch mechanism in an engaged position 148 until it is moved to a disengaged position (not shown). The latch bar 139 is moved between the engaged position 148 and the disengaged position by a conventional solenoid 150. It should be understood that it is fully within the contemplation of this invention that this operation may also be performed manually by lifting up on the extension 128 of the latch bar 139 extending through the opening 126.

The solenoid 150 is provided to allow the hunter to move the colored lens assembly 22 from a closed position 24 to an open position 26 without requiring him to move the gun from a sighting position and with little physical movement by him likely to frighten the hunted prey. The solenoid 150 may be remotely activated to move the latch bar 139 from an engaged position 148 to a disengaged position thereby allowing the colored lens assembly 22 to move from the closed position 24 to the open position 26 as will be hereinafter more fully described.

The solenoid 150 is mounted on the seating lug 145 of the clear lens assembly 23 and has a piston 152 which moves between a lowered and a raised position. When the piston 152 is in the lowered position, the latch mechanism 124 is free to engage the colored lens assembly 22 and hold the colored lens assembly in the closed position 24. When the solenoid 150 is activated, the piston 152 moves to a raised position. The solenoid 150 is positioned with respect to the latch bar 139 so that when its piston 152 is moved to a raised position, the piston engages the latch bar 139 and moves it to a disengaged position. When the latch bar 139 is so moved, the colored lens assembly 22 moves to an open position 26 by the force exerted thereon by the torsional spring 135. As will be hereinafter more fully described, the solenoid 150 is selectively connected to the batteries 62 by certain wires of the circuit 75 which also includes the contact clips 156 and 157.

When the colored lens assembly 22 is in the open position 26, the clear lens assembly 23 has a clear lens 158 through which a bright light may emanate along the path 13 shown in FIG. 8.

Referring to FIGS. 8 and 12, the clear lens 158 of the clear lens assembly 23 is held in place by a retainer ring 159, an 0-ring gasket 160, and the seating lug 145. The retainer ring 159 threadably engages the seating lug 145. When assembled, the retainer ring 159 compressively engages the gasket 160 which exerts pressure on the clear lens 158. The pressure exerted by the gasket 160 urges the clear lens 158 against a ledge 162 of the seating lug 145 to hold the clear lens in place. The gasket 160 also provides a watertight seal around the clear lens 158.

A micro switch 167 mounted to a shell 163 of the seating lug 145 above the latch bar 139 is provided as part of a bypass circuit 21 as will be hereinafter more fully described. The piston 169 of the switch 167 engages a rest 171 on the seating lug 120 when the colored lens assembly 22 is in the closed position 24. When the colored lens assembly 22 is opened, the piston 169 moves outward from the switch 167 so as to activate the bypass circuit 21. The switch 167 is electrically connected to the batteries 54 by certain wires of the bypass circuit 21 which includes the contact clips 179 and 181 as will be hereinafter more fully described.

The means 68 for mounting the power supply 14 and the floodlight 12 to the rifle 41 is shown in FIGS. 1, 13, and 14 and includes the front and rear mounting clamps 164, 165 respectively. The front mounting clamp 164 is not shown in a detailed form on any of the accompanying figures, but it should be understood that the rear mounting clamp 165 shown detailed in FIGS. 13 and 14 generally represents the front clamp 164 with minor alterations as will be hereinafter more fully described.

Each of the mounting clamps 164 and 165 includes a set of identically shaped, opposed sections or legs 166. The legs 166 have gripping flanges 168 on their lower ends 170, and a barrel gripping section 172 on their upper ends 174. A magazine gripping section 175 is included in the legs 166 to allow for the mounting of the power supply 14 and the floodlight 12 onto a tube fed automatic rifle (not shown). The gripping flanges 168 on the legs 166 are shaped to engage the mounting grooves 92 of the mounting brackets 86 and 88 of the battery case 52. Rubber gaskets (not shown), shaped to fit between the legs 166 and the mounting brackets 86 and 88, make the connections watertight to avoid exposure to moisture of the electrical components in the legs and brackets which will be hereinafter more fully described.

The barrel gripping section 172 of the legs 166 is shaped to fit the gun barrel 90 of the rifle 41. The magazine gripping section 175 of the legs 166 is shaped to fit the loading tube (not shown) of an automatic tube fed rifle 41, but it should be understood that it is within the contemplation of the present invention to use the system 10 on any other type of firearm. The barrel and magazine gripping sections 172, 175 respectively also include a cushioned surface 176 of resilient material so as not to scratch the surface of the barrel 90 and magazine (not shown), and to improve the gripping characteristics of the mounting clamps 164 and 165. When tightened, the upper mounting screw 178 and nut 180 and the lower mounting screws 182 and nuts 184 force the complimentary legs 166 to grip the barrel 90, the magazine (not shown), and the mounting brackets 86 and 88, thereby mounting the power supply 14 and the floodlight 12 to the rifle 41. It should be understood that it is within the contemplation of the present invention to provide bushings (not shown) in the mounting means 68 to facilitate mounting the luminous gun sighting system 10 on firearms of various caliber or gauge.

In the embodiment of the present invention shown in FIG. 1, the sight means 30 is shown as it would appear when mounted to the rifle 41. The sight means 30 includes a hollow, opaque tube 186 constructed of a lightweight material, preferably plastic or thin walled aluminum mounted on the rifle 41 as will be hereinafter described. It should be understood that it is within the contemplation of this invention to mount the batteries 66 of the power supply 19 in the tube 186.

As shown in FIG. 2, the front sight 32 of the sight means 30 includes an upper or sighting half 187, a light source 188, a lower or receptacle half 190, and a means 191 for mounting the sighting half to the tube 186.

The sighting half 187 shown in FIGS. 2 and 3 is constructed of a clear, light transmitting plastic material such as polystyrene and has a front face 196, a rear face 198, side faces 199, and a bottom face 200. A cavity 193 is bored into the sighting half 187 through its bottom face 200 to accommodate the light source 188.

The light source 188 is a light emitting diode (LED), preferably red, but it should be understood that it is within the contemplation of this invention that other available light sources known to those skilled in the art, such as commercial light bulbs or the like, may also be used. The LED 188 includes two electrical contact pins 195. The LED 188 fits within the bore 193 so as to be readily removable therefrom. When the LED 188 is installed in the sighting half 187, the electrical contact pins 195 protrude from the bottom face 200 of the sighting half.

The curved, angularly disposed front face 196 of the sighting half 187 is formed at approximately a 45° angle relative to the vertically disposed rear face 198 to provide a reflecting surface for the light rays passing through the body of the sighting half to reflect light directly toward the hunter's eye.

The receptacle half 190 of the sight 32 is essentially an outlet in which to plug the contact pins 195 of the LED 188. The receptacle half 190 includes a body member 201 and two electrical sockets 202. The body member 201 is mounted in the wall of the tube 186 by any conventional means known to those skilled in the art so that the sockets 202 are properly positioned to accept the contact pins 195 of the LED 188. The sockets 202 are electrically connected in the circuit 76 as will be hereinafter more fully described.

When the sighting half 187 of the sight 32 is mounted to the tube 186 by the means 191, the contact pins 195 of the LED 188 plug into the sockets 202 in the receptacle half 190. The mounting means 191 includes the mounting clips 192 and the screws 194. The clips 192 engage the sighting half 187 and secure it to the tube 186 when the screws 194 are screwed into the walls of the tube. A rubber or plastic gasket 197 is positioned on the tube 186 beneath tha clips 192 and the sighting half 187 to insure a waterproof fit between the sighting half and the tube 186. The gasket 197 is appropriately slotted to accommodate the screws 194 and the pins 195.

In order to minimize the chances of frightening the hunted prey, a means 205 is provided to resist the passage of light through the front face 196 and the side faces 199 of the front sight 32. One such means includes masking the front face 196 and the side faces 199 by painting them with a dull, flat black paint so as to permit the passage of light only through the rear face 198 of the front sight 32. It should be understood that it is within the contemplation of this invention to use other available means of resisting the passage of light through the front and side faces 196, 199 respectively, while allowing light to pass through the rear face 198.

The front portion of the tube 186 of the sight means 30 is attached to the firearm 41 by the front mounting assembly 203 which includes the means 38 for adjusting the front sight 32. The means 38 contains a front sight adjustment mechanism 204. The front sight adjustment mechanism 204 is mounted to the front end 206 of the gun barrel 90, as shown in FIGS. 2 and 3. The front sight adjustment mechanism 204, preferably constructed of metal, permits the accurate positioning of the front sight 32 by allowing compensation for the trajectory of the projectile fired by the weapon relative to target distance. The front sight adjustment mechanism 204 includes an upper adjustment block 208 which is threadably fitted to a lower adjustment block 210 by way of an inclined dovetail joint 212. A threaded adjustment screw 214 threadably engages the upper block 208 and is rotatably mounted and axially secured to the tube 186 by a bushing 213 mounted in the screw mount 215 which is attached to the tube by any conventional means, such as by adhesives, soldering, or the like, or molded cast.

The outward end of the adjustment screw 214 has an adjustment knob 216 which may be used to rotate the screw either in a clockwise or counter-clockwise direction in order to raise or lower the front gun sight 32.

This movement will alter the vertical aim of the firearm 41 according to the user's desires.

To allow fine adjustment of the adjustment screw 214, the knob 216 has a system of gradations 217 on its rear face 218 which contact a bead 219 affixed to the mount 215. A horseshoe retainer clip 221, fitting within a channel 223 circumferentially inscribed in the screw 214, and a compression washer 225, which abuts the clip and the bushing 213, are provided to keep the gradations 217 in contact with the bead 219 and to avoid slippage of the adjustment screw once it is properly set by the hunter.

The upper adjustment block 208 is attached to the tube 186 by way of the interfitting lugged arrangement 220, shown in FIG. 3. Mounting arms 222 are secured to the tube 186 and are formed to allow interconnection with the top edge 224 of the upper block 208. The lower adjustment block 210 is attached to the barrel 90 by way of downwardly extending mounting straps 226. The straps 226 are hingedly attached to the lower adjustment block 210. A barrel gripping section 209 and a magazine gripping section 211 of the straps 226 include a cushioned surface 213 of resilient material so as not to scratch the surface of the barrel 90 or the magazine (not shown) and to improve the gripping characteristics of the mounting straps. The mounting straps 226 partially encircle the outer periphery of the barrel 90 and are secured thereto by the fasteners 228. It should be understood that it is within the contemplation of the present invention to use bushings (not shown) with the straps 226 to facilitate mounting the tube 186 on firearms of various caliber or gauge.

Figure 6:
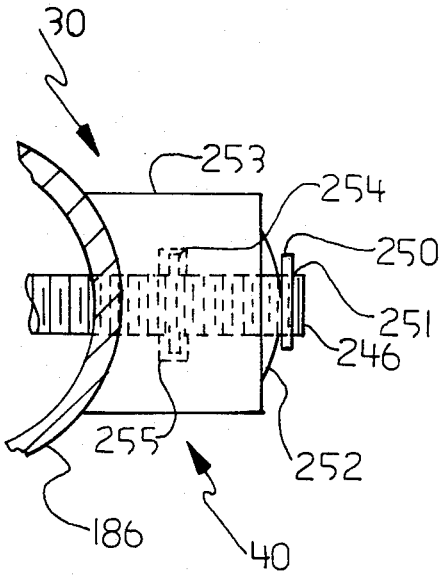
FIG. 6 is an enlarged, partial cross-sectional view of the adjustment means of the rear, lighted gun sight shown in FIG. 4.

The rear sight 34 shown in FIGS. 4, 5, and 6 includes an upper or sighting half 229, a light source 189, a lower or receptacle half 231, a means 233 for mounting the sighting half to the tube 186 and the adjustment means 40. The sighting half 229 is constructed of a clear, light transmitting plastic material, such as polystyrene, and includes a front face 230, a rear face 232, side faces 234, and a bottom face 235. The front face and side faces 230, 234 respectively, are masked by the means 227 similar to the means 205 of the front sight 32 to permit the transmission of light only through the rear face 232. A cavity 236 is bored into the sighting half 229 through its bottom face 235 to accommodate the light source 189.

The light source 189 is a light emitting diode (LED), preferably red, but it should be understood that it is within the contemplation of this invention that other available light sources known to those skilled in the art, such as commercial light bulbs or the like, may also be used. The LED 189 includes two electrical contact pins 237. The LED 189 fits within the bore 236 so as to be readily removable therefrom. When the LED 189 is installed in the sighting half 229, the electrical contact pins 237 protrude from the bottom face 235 of the sighting half.

The means 233 for mounting the sighting half 229 to the tube 186 includes the mounting clips 238 and the screws 239. The clips 238 engage the sighting half 229 and secure it to the tube 186 when the screws 239 are secured into the walls of the tube. A rubber or plastic gasket 240 is positioned beneath the clips 238 and the sighting half 229 to insure a watertight seal between the sighting half and the tube 186. The gasket 240 is appropriately slotted to accommodate the screws 239 and the pins 237.

The receptacle half 231 of the sight 34 is both an outlet in which to plug the contact pins 237 of the LED 189, and a part of the adjustment means 40.

The receptacle half 231 includes a body member 241, two electrical sockets 242, and a mounting leg 243. The sockets 242 are mounted to the body member 241 to accept the pins 237 of the LED 189 when the sighting half 229 is properly mounted. As will be hereinafter more fully described, the sockets 242 are electrically connected in the circuit 76.

The body member 241 is adjustably mounted to the tube 186 by the adjustment means 40. As shown in FIG. 5, the body member 241 is generally rectangular in rear view and slideably fitted within a transversely extending slot 244 formed in the tube 186. A rubber or plastic gasket 245 is provided to fit between the body member 241 and the tube 186 to provide a watertight connection.

The mounting leg 243 is threadedly mounted on an adjustment screw 246 which extends transversely through the leg and the tube 186. The adjustment screw 246 has an adjustment knob 247 on one end and is slideably fitted through an opening 248 in a mounting block 249 at that end. The mounting block 249 is mounted to the tube 186. The other end of the screw 246 is secured to the tube 186 by a horseshoe retainer clip 250 in a circumferential recess 251 of the screw, and a compression washer 252. The compression washer 252 fits snugly between the horseshoe retainer clip 250 and a bushing 253 which is mounted to the tube 186. A rubber or plastic O-ring washer 254 fits within a recess 255 inside of the bushing 253 to provide a watertight seal around one end of the screw 246. Another rubber or plastic O-ring washer 254 fits within a recess 256 inside of the mounting block 249 to provide a watertight seal around the other end of the screw 246.

As seen in FIG. 5, by loosening the screws 239 and rotating the adjustment knob 247, the adjustment screw 246 is rotated and moves the rear sight 34 transversely to the right or left. Such transverse adjustment permits the user to adjust the sight 30 for windage or misalignment.

To permit fine adjustment of the adjustment screw 246, the knob 247 has a system of gradations 257 on its side face 258 which contact a bead 259 affixed to the mounting block 249. The compression washer 252 keeps the gradations in contact with the bead 259 and prevents slippage of the adjustment screw 246 once the hunter has finished making his adjustments.

Figure 7:
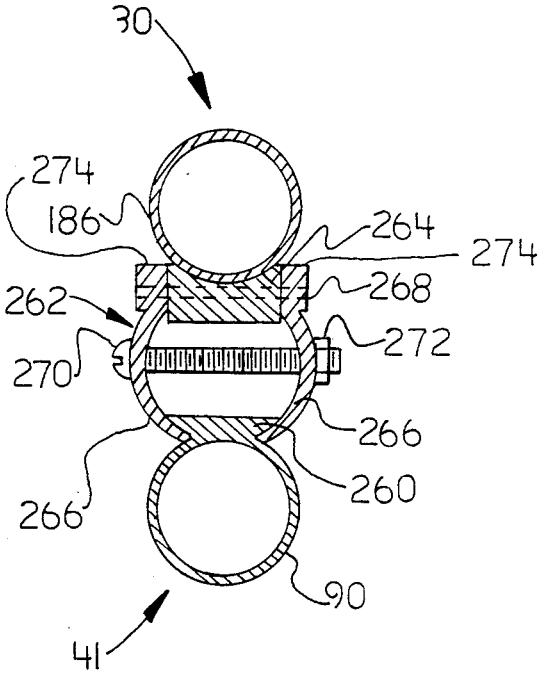
FIG. 7 is a cross-sectional view taken along line 7—7 of FIG. 4.

The rear portion of the tube 186 of the sight means 30 is attached to a conventional telescope mounting lug 260 of the rifle 41 by the rear mounting assembly 262 shown in FIGS. 4 and 7. The mounting assembly 262 includes a rear mounting lug 264, two opposed curved elements 266, a pin 268, a screw 270, and a nut 272. The curved elements 266 are formed to accept the rear mounting lug 264 which is secured to the tube 186. The pin 268 passes transversely through the rear lug 264 and the heads 274 of the curved elements 266 to secure the curved elements to the lug. The single pin 268 also provides a pivot point for the tube 186 to allow vertical adjustment of the front end of the tube by the adjustment means 38 without distorting the tube. The curved elements 266 compressively engage the telescope mounting lug 260 to hold the rear portion of the tube 186 on the rifle 41 when the screw 270 and nut 272 are tightened.

To implement supplying power to the front and rear light sources 188 and 189, respectively, the tube 186 also includes front and rear electrical junction boxes 286, 288 respectively. The junction boxes 286, 288 are mounted to the underside of the tube 186 adjacent to the tube wall openings 292, 293 respectively, as shown in FIG. 15, by the screws 289 and the gaskets 290 or any conventional means known to those skilled in the art, such as by soldering, using adhesives, or the like. The combination of these watertight connections and the watertight mounting of the sights 32 and 34 makes the tube 186 watertight.

The circuit means 18, 75, and 76 which selectively connect and disconnect power to and from the floodlight 12, the solenoid 150 and the LED's 188, 189 respectively, are designed in modules as shown in FIG. 17 to allow certain advantageous features of the present invention. This modular design allows the gun sighting system 10 of the present invention to be easily assembled and disassembled on an existing firearm and also allows for easy transfer of the luminous gun sighting system from one firearm to another. In addition, this modular design allows for simplified replacement of various components of the luminous gun sighting system 10 as will be hereinafter more fully described. It should be understood that it is within the contemplation of this invention to provide watertight and shock resistant connections between all the modules herein described. It may be desirable to use different sight means for different types of firearms, for example rifles and shotguns. The modular design hereafter described allows for easy modification of the circuitry to allow the use of different sight means 30.

The modular design includes modules 294, 296, 298, 299, 300, 302, 304, and 306 indicated by dashed lines in FIG. 17. It should be understood that each module includes a bundle of wires interconnecting components at each end of that bundle of wires. The switch module 294 has a bundle of wires 308 interconnecting a 7-hole socket 310, a three-position switch 312, a pushbutton switch 314, and a means for adjusting the intensity of the light emitted from the light 44, such as a rheostat 315. The rear conduit module 296 has a bundle of wires 316 interconnecting two 7-prong plugs 318 and 320, and a conduit 321. The tube module 298 includes a bundle of wires 322 interconnecting a 7-prong plug 324, a 7-hole socket 326, the sockets 202 and the LED 188 of the front sight 32, the sockets 242 and the LED 189 of the rear sight 34, and a means for adjusting the intensity of the light provided by the illuminating means 36, such as a rheostat 328. The junction boxes 286 and 288 are also included in the tube module 298. The front conduit module 299 includes a bundle of wires 432 interconnecting a 7-prong plug 434 and a 7-hole socket 436, and a conduit 438. The rear power mounting clamp module 300 includes the wiring bundle 334 which interconnects the 7-hole socket 336 and the 7-point contact set 338. The rear power mounting bracket module 302 includes the wiring bundle 340 which connects the seven pins 96 to certain wiring of the front power mounting bracket module 306 and the power supplies 15, 17, and 19. The front power mounting clamp module 304 includes the wiring bundle 342 which interconnects the two contacts of a 2-point contact set 344. The front power mounting bracket module 306 includes a wiring bundle 346 which interconnects the two pins 97 with the power supply 19 and certain wiring from the rear power mounting bracket module 302.

Referring to FIGS. 1, 15, and 17, the modules 294, 296, 298, 299, 300, 302, 304, and 306 are mounted to the rifle 41 to allow for easy assembly and disassembly of the luminous gun sighting system 10 in the home or shop as well as in the field. The modules 294, 296, 298, 299, 300, 302, 304, and 306 are likewise located on the firearm to facilitate the use of the luminous gun sighting system 10 by the hunter.

The switch module 294 is conveniently mounted adjacent to the trigger 348 of the rifle 41 for quick and easy operation. The switches 312 and 314 and the rheostat 315 of the switch module 294 are located close enough to the trigger 348 to allow the hunter to operate them without moving his hand away from the trigger. The 7-hole socket 310 of the switch module 294 is mounted to slideably interfit with the 7-prong plug 320 of the rear conduit module 296. The switch module 294 is secured to the rifle 41 by the screws 350, but it should be understood that it is within the contemplation of this invention to use any appropriate means known to those skilled in the art which facilitates mounting and removal of the switch module from the rifle by the hunter.

The rear conduit module 296 is located on the rifle 41 between the switch module 294 and the tube module 298. The wiring bundle 316 of the rear conduit module 296 is located inside the watertight conduit 321 to avoid exposure to moisture. The 7-prong plugs 318 and 320 of the rear conduit module 296 are connected to the front and rear ends respectively of the conduit 321 of the rear conduit module. The 7-prong plug 320 is mounted to the conduit 321 to slideably interfit with the 7-hole socket 310 of the switch module 294. The 7-prong plug 318 is mounted to the conduit 321 to slideably interfit with the 7-hole socket 326 of the tube module 298. The rear conduit module 296 is removably mounted to the rifle 41 by any conventional means known to those skilled in the art, such as by clamping, taping or the like.

The tube module 298 is mounted to the rifle 41 as previously described for the sight means 30. The wiring bundle 322 of the tube module 298 is located inside the watertight tube 186 to avoid exposure to moisture. The 7-hole socket 326 of the tube module 298 is mounted in the junction box 288 to slideably interfit with the 7-prong plug 318 of the rear conduit module 296. The 7-prong plug 324 of the tube module 298 is mounted in the front junction box 286 to slideably interfit with the 7-hole socket 436 of the front conduit module 299. The sockets 202 and 242 of the tube module 298 are mounted in the sights 32 and 34, respectively as previously described. For ease of operation, the rheostat 328 of the tube module 298 is conveniently mounted to the tube 186.

The front conduit module 299 is located on the rifle 41 between the tube module 298 and the rear power mounting clamp module 300. The wiring bundle 432 of the front conduit module 299 is located inside the watertight conduit 438 to avoid exposure to moisture. The 7-prong plug 434 and the 7-hole socket 436 of the front conduit module 299 are connected to the front and rear ends respectively of the conduit 438 of the front conduit module. The 7-prong plug 434 is mounted to the conduit 438 to slideably interfit with the 7-hole socket 336 of the rear power mounting clamp module 300. The 7-hole socket 436 is mounted to the conduit 438 to slideably interfit with the 7-prong plug 324 of the tube module 298. The front conduit module 299 is removably mounted to the tube 186 by any conventional means known to those skilled in the art, such as by clamping, taping, or the like.

The rear power mounting clamp module 300 is mounted in the rear mounting clamp 165 as shown in FIGS. 13, 14, and 15. The 7-point contact set 338 of the rear power mounting clamp module 300 is mounted in the gripping flanges 168 of the legs 166 to electrically contact the seven pins 96 of the rear power mounting bracket module 302 when the luminous gun sighting system 10 is assembled. The wiring bundle 334 of the rear power mounting clamp module 300 is secured to the legs 166 of the clamp 165 by any conventional means known to those skilled in the art. One such means includes encapsulating the wiring bundle 334 within wiring grooves in the legs 166 and cementing the bundle in place. The 7-hole socket 336 of the rear power mounting clamp module 300 is mounted to the top rear face of the clamp 165 to slideably interfit with the 7-prong plug 434 of the front conduit module 299.

The rear power mounting bracket module 302 is mounted to the battery case 52 as previously described for the bracket 88. As previously described, the seven pins 96 are mounted in the mounting grooves 92 of the bracket 88. The wiring bundle 340 of the rear power mounting bracket module 302 is mounted within the bracket 88 in the wiring slot 94 and passes through the wiring slot 84 of the battery case 52 into the battery case.

The front power mounting clamp module 304 shown in FIGS. 1, 15, and 17 is mounted in the front mounting clamp 164. The 2-point contact set 344 of the front power mounting clamp module 304 is mounted in the gripping flanges 168 of the legs 166 (FIGS. 13 and 14) to electrically contact the two pins 97 of the front power mounting bracket module 306 when the luminous gun sighting system 10 is assembled. The wiring bundle 342 of the front power mounting clamp module 304 is secured to the legs 166 (FIGS. 13 and 14) of the clamp 164 in the same manner as the wiring bundle 334 of the rear power mounting clamp module 300 is mounted to the legs 166 of the clamp 165.

The front power mounting bracket module 306 is mounted to the battery case 52 as previously described for the mounting bracket 86 (FIG. 8). As previously described, the two pins 97 are mounted in the mounting grooves 92 (FIG. 8) of the mounting bracket 86. The wiring bundle 346 of the front power mounting bracket module 306 is mounted within the bracket 86 in the wiring slot 95 (FIG. 8) and passes through the slot 89 (FIG. 8) of the battery case 52 into the battery case.

The circuit means 18, 75, and 76 interconnect the floodlight 12, the solenoid 150, and the LED's 188, 189 respectively with the switches 312 and 314 as seen in FIG. 17. The circuit described schematically in FIG. 17 is particularly designed for mounting the gun sighting system 10 of the present invention on a rifle 41. It should be understood that the gun sighting system 10 may be mounted on any other firearm including a shotgun.

The light 44 is connected to the power supply 14 by means of the circuit 18 which provides for selective activation of the light by means of the switch 312. The rheostat 315 is provided to adjust the intensity of the brightness of the light 44 as will be hereinafter more fully described. The circuit means 18 includes the wires 308*a* and *b* and 309 in the wiring bundle 308 of the module 294, the wires 316*a* and *b* in the wiring bundle 316 of the module 296, the wires 322*a* and *b* in the wiring bundle 322 of the module 298, the wires 432*a* and *b* of the wiring bundle 432 in the module 299, the wires 334*a* and *b* of the wiring bundle 334 in the module 300, and the wires 340*a* and *b* in the wiring bundle 340 of the module 302.

The wires 308*a* and *b*, 309, 316*a* and *b*, 322*a* and *b*, 432*a* and *b*, 334*a* and *b*, and 340*a* and *b* are connected to the various plugs, sockets, pins, contacts, and terminals of the luminous gun sighting system 10 as hereinafter described. For ease of description, the prongs, socket holes, contacts, and terminals of the plugs, sockets, contacts, switches, solenoid, light, and rheostat shall be hereafter denoted by the appropriate alphabetical suffix (a, b, c, etc.). It should be understood that this same suffix system is used in the description of the circuits 75 and 76 following the description of the circuit 18.

The wire 308*a* of the wiring bundle 308 is connected on one end to the terminal 321*a* of the switch 312 and on the other end to the terminal 315*a* of the rheostat 315. The wire 309 of the wiring bundle 308 is connected on one end to the terminal 315*b* of the rheostat 315 and at the other end to the socket 310*a* of the 7-hole socket 310. The wire 316*a* of the wiring bundle 316 interconnects the prong 320*a* of the 7-prong plug 320 and the prong 318*a* of the 7-prong plug 318. The wire 322*a* of the wiring bundle 322 interconnects the socket 326*a* of the 7-hole socket 326 and the prong 324*a* of the 7-prong plug 324. The wire 432*a* is connected on one end to the socket 436*a* of the 7-hole socket 436 and at the other end to the prong 434*a* of the 7-prong plug 434. The wire 334*a* of the wiring bundle 334 is connected on one end to the socket 336*a* of the 7-hole socket 336 and at the other end to the contact 338*a* of the 7-point contact set 338. The wire 340*a* of the wiring bundle 340 interconnects the pin 96*a* of the seven pins 96 and the rear contact spring 58 of the battery case 52. As previously described, the rear contact spring 58 electrically contacts the negative terminal of the rearmost battery 54 of the power supply 15. The electrical contact 50 electrically contacts the positive terminal of the forwardmost battery 54 of the power supply 15 as previously described. The other end of the contact 50 contacts the contact 63 of the light bulb 44.

The wire 340*b* of the wiring bundle 340 interconnects the contact 67 of the light bulb 44 and the pin 96*b* of the seven pins 96. The wire 334*b* of the wiring bundle 334 electrically connects the contact 338*b* of the 7-point contact set 338 and the socket 336*b* of the 7-hole socket 336. The wire 432*b* of the wiring bundle 432 interconnects the prong 434*b* of the 7-prong plug 434 and the socket 436*b* of the 7-hole socket 436. The wire 322*b* of the wiring bundle 322 electrically connects the prong 324*b* of the 7-prong plug 324 and the socket 326*b* of the 7-hole socket 326. The wire 316*b* of the wiring bundle 316 interconnects the prong 318*b* of the 7-prong plug 318 and the prong 320*b* of the 7-prong plug 320. The wire 308*b* of the wiring bundle 308 electrically interconnects the socket 310*b* of the 7-hole socket 310 and the terminal 312*b* of the switch 312.

The bypass circuit 21 is provided to bypass the switch 312 and activate the light bulb 44 whenever the colored lens assembly 22 (FIG. 1) is in the open position. The circuit 21 includes the wires 173, 177, 354, and 356. The wire 354 interconnects the rear contact spring 58 of the battery case 52 and the contact clip 179*a* of the contact clips 179. The wire 173 interconnects the contact clip 179*b* of the contact clips 179 and the terminal 167*a* of the microswitch 167. The wire 177 interconnects the contact clip 181*a* of the contact clips 181 and the terminal 167*b* of the microswitch 167. The wire 356 electrically interconnects the contact clip 181*b* of the contact clips 181 and the contact 67 of the light bulb 44.

The solenoid 150 is electrically connected to the power supply 17 by means of the circuit 75 which provides for selective activation of the solenoid by means of the switch 314. The circuit 75 includes the wires 308*c* and *d* of the wiring bundle 308, the wires 316*c* and *d* of the wiring bundle 316, the wires 322*c* and *d* of the wiring bundle 322, the wires 432*c* and *d* of the wiring bundle 432, the wires 334*c* and *d* of the wiring bundle 334, the wires 340*c* and *d* of the wiring bundle 340, and the wires 154, 155 and 358.

The wire 308*c* of the wiring bundle 308 electrically interconnects the terminal 314*c* of the switch 314 and the socket 310*c* of the 7-hole socket 310. The wire 316*c* of the wiring bundle 316 interconnects the prong 320*c* of the 7-prong plug 320 and the prong 318*c* of the 7-prong plug 318. The wire 322*c* of the wiring bundle 322 interconnects the socket 326*c* of the 7-hole socket 326 and the prong 324*c* of the 7-prong plug 324. The wire 432*c* of the wiring bundle 432 connects the socket 436*c* of the 7-hole socket 436 to the prong 434*c* of the 7-prong plug 434. The wire 334*c* of the wiring bundle 334 connects the socket 336*c* of the 7-hole socket 336 to the contact 338*c* of the 7-point contact set 338. The wire 340*c* of the wiring bundle 340 electrically interconnects the pin 96*c* of the seven pins 96 and the contact spring 71 of the battery case 60. The contact spring 71 electrically interconnects the negative terminals of the batteries 62 and the wire 340*c*. The front contact 72 of the battery case 60 electrically interconnects the positive terminals of the batteries 62 and the wire 358. The wire 358 interconnects the front contact 72 and the contact clip 156*a* of the contact clips 156. The wire 154 interconnects the contact clip 156*b* of the contact clips 156 and the terminal 150*a* of the solenoid 150. The wire 155 electrically interconnects the terminal 150*b* of the solenoid 150 and the contact clip 157*a* of the contact clips 157. The wire 340*d* of the wiring bundle 340 interconnects the contact clip 157*b* of the contact clips 157 and the pin 96*d* of the seven pins 96. The wire 334*d* of the wiring bundle 334 electrically interconnects the contact 338*d* of the 7-point contact set 338 and the socket 336*d* of the 7-hole socket 336. The wire 432*d* of the wiring bundle 432 connects the prong 434*d* of the 7-prong plug 434 to the socket 436*d* of the 7-hole socket 436. The wire 322*d* of the wiring bundle 322 electrically interconnects the prong 324*d* of the 7-prong plug 324 and the socket 326*d* of the 7-hole socket 326. The wire 316*d* interconnects the prong 318*d* of the 7-prong plug 318 and the prong 320*d* of the 7-prong plug 320. The wire 308*d* interconnects the socket 310*d* of the 7-hole socket 310 and the terminal 314*d* of the switch 314. Closing the switch 314 completes the circuit 75 as will be hereinafter more fully described.

The sight lights 188 and 189 are interconnected to the power supply 19 by means of the circuit 76 which provides for selective activation of the sight lights by means of the switch 312. The rheostat 328 is provided to adjust the brightness of the rear sight light 189 as will be hereinafter more fully described. The circuit 76 includes the wires 308*e* and *f* of the wiring bundle 308, the wires 316*e* and *f* of the wiring bundle 316, the wires 322*e*, *f* and *g*, the wire 323*f*, and the wire 325*f* of the wiring bundle 322, the wires 432*e*, *f*, and *g* of the wiring bundle 432, the wires 334*e*, *f*, and *g* of the wiring bundle 334, the wires 340*e*, *f* and *g* of the wiring bundle 340, the wire 342*h* of the wiring bundle 342 and the wires 346*h* and *i* of the wiring bundle 346.

The wire 308*e* electrically interconnects the terminal 312*e* of the switch 312 and the socket 310*e* of the 7-hole socket 310. The wire 316*e* interconnects the prong 320*e* of the 7-prong plug 320 and the prong 318*e* of the 7-prong plug 318. The wire 322*e* interconnects the socket 326*e* of the 7-hole socket 326 and the prong 324*e* of the 7-prong plug 324. The wire 432*e* connects the socket 436*e* of the 7-hole socket 436 to the prong 434*e* of the 7-prong plug 434. The wire 334*e* electrically interconnects the socket 336*e* of the 7-hole socket 336 and the contact 338*e* of the 7-point contact set 338. The wire 340*e* interconnects the pin 96*e* of the seven pins 96 and the contact spring 71 of the battery case 64. The contact spring 71 electrically interconnects the wire 340*e* and the negative terminals of the rearmost batteries 66.

The front contact 79 of the battery case 64 electrically interconnects the positive terminal of the forwardmost battery in one pair of the batteries 66 and the wire 346*i*. The wire 346*i* electrically interconnects the front contact 79 and the pin 97*i* of the two pins 97. The wire 342*h* electrically interconnects the contacts 344*h* and *i* of the 2-point contact set 344. The wire 346*h* electrically interconnects the pin 97*h* of the two pins 97 and the wire 340*g*. The wire 340*g* interconnects the wire 346*h* and the pin 96*g* of the seven pins 96. The wire 334*g* electrically interconnects the contact 338*g* of the 7-point contact set 338 and the socket 336*g* of the 7-hole socket 336. The wire 432*g* connects the prong 434*g* of the 7-prong plug 434 to the socket 436*g* of the 7-hole socket 436. The wire 322*g* interconnects the prong 324*g* of the 7-prong plug 324 and the socket 202*a* of the socket 202 of the front sight 32.

The wire 322*f* electrically interconnects 3 different components of the luminous gun sighting system 10, that is, the wire 322*f* electrically interconnects the socket 202*a* of the sockets 202 of the front sight 32, the terminal 328*a* of the rheostat 328, and the socket 326*f* of the 7-hole socket 326. That part of the circuit 76 between the rheostat 328 and the front contact 73 of the battery case 64 will be described first, followed by the description of the part of the circuit 76 between the 7-hole socket 326 and the switch 312.

The wire 323*f* electrically interconnects the terminal 328*b* of the rheostat 328 and the socket 242*a* of the sockets 242 of the rear sight 34. The wire 325*f* interconnects the socket 242*b* of the sockets 242 of the rear sight 34 and the prong 324*f* of the 7-prong plug 324. The wire 432*f* connects the socket 436*f* of the 7-hole socket 436 to the prong 434*f* of the 7-prong plug 434. The wire 334*f* electrically interconnects the socket 336*f* of the 7-hole socket 336 and the contact 338*f* of the 7-point contact set 338. The wire 340*f* interconnects the pin 96*f* of the seven pins 96 and the front contact 73 of the battery case 64. The front contact 73 electrically interconnects the wire 340*f* and the positive terminal of the forwardmost battery of the other pair of batteries 66 not previously mentioned in the description of the circuit 76.

That part of the circuit 76 between the 7-hole socket 326 and the switch 312 starts with the wire 316*f* which electrically interconnects the prong 318*f* of the 7-prong plug 318 and the prong 320*f* of the 7-prong plug 320. The wire 308*f* electrically interconnects the socket 310*f* of the 7-hole socket 310 and the terminal 312*f* of the switch 312. When the switch 312 is closed across the terminals 312*e* and *f*, the circuit 76 is completed as will be hereinafter more fully described.

As previously described, the circuit means 18, 75, and 76 which selectively connect and disconnect power to and from the floodlight 12, the solenoid 150 and the LED's 188, 189 respectively are operated by operation of the switches 312 and 314 of the switch module 294. The switch 312 has three positions: a null position 360; a sights-only position 362 that activates only the LED's 188, 189 of the sighting means 30; and a light-and-sights position 364 which contemporaneously activates the light bulb 44 of the floodlight 12 and the LED's 188 and 189. The pushbutton switch 314 has a normally open or null position 366, and a depressed or closed position 368 which activates the solenoid 150 to open the colored lens assembly 22 (FIG. 1).

In the null position 360, the switch 312 activates nothing and the luminous gun sighting system 10 is deactivated. In the sights-only position 362, the terminals 312*e* and *f* of the switch 312 are connected and the circuit 76 is completed. In this position, the hunter has the use of the front and rear sights 32, 34 respectively but not the floodlight 12. It should be understood that the floodlight 12 may be activated by either manually or electrically opening the colored lens assembly 22 with the switch 312 in any of its three positions as will be hereinafter more fully described.

The circuit 76 proceeds from the terminal 312*e* of the switch 312 through the socket 310*e*, the prong 320*e*, the prong 318*e*, the socket 326*e*, the prong 324*e*, the socket 436*e*, the prong 434*e*, the socket 336*e*, the contact 338*e*, and the pin 96*e* to the contact spring 71 which contacts the negative terminals of the rearmost batteries 66 in the battery case 64. The circuit 76 then passes through the batteries 66 to the front contacts 73 and 79 of the battery case 64. From the contact 79, the circuit 76 proceeds through the pin 97*i*, the contact 344*i*, the contact 344*h*, the pin 97*h*, the pin 96*g*, the contact 338*g*, the socket 336*g*, the prong 434*g*, the socket 436*g*, the prong 324*g* and the socket 202*b* to the LED 188.

The circuit 76 then goes through the LED 188 and the socket 202*a* to both the rheostat 328 and the socket 326*f*. That part of the circuit 76 proceeding from the rheostat 328 to the front contact 73 will be described first, followed by the description of that part of the circuit 76 proceeding from the socket 326*f* to the terminal 312*f* of the switch 312.

As previously described, the rheostat 328 allows for the variance of the intensity of the brightness of the rear sight 34 by controlling the amount of current flowing to the LED 189. The circuit 76 proceeds from the rheostat 328 to the socket 242*a*, through the LED 189 and the socket 242*b* to the prong 324*f*, tje socket 436*f*, the prong 434*f*, the socket 336*f*, the contact 338*f*, and the pin 96*f* to the front contact 73 of the battery case 64. The other part of the circuit 76 between the socket 326*f* and the switch 312 proceeds through the socket 326*f*, the prong 318*f*, the prong 320*f*, and the socket 310*f* to the terminal 312*f* of the switch 312.

In the light-and-sights position 364, the switch 312 closes both the wiring circuits 18 and 76, thereby lighting the floodlight 12 and the LED's 188 and 189. In this position 364, the circuit 76 operates as previously described for the switch position 362.

The circuit 18 starts at the terminal 312*a* of the switch 312 and proceeds to the rheostat 315. The rheostat 315, as previously described, allows for the varying of the intensity of the brightness of the floodlight 12 when the colored lens assembly 22 is in the closed position 24 by controlling the amount of current flowing thereto. The circuit 18 proceeds from the rheostat 315 through the socket 310*a*, the prong 320*a*, the prong 318*a*, the socket 326*a*, the prong 324*a*, the socket 436*a*, the prong 434*a*, the socket 336*a*, the contact 338*a* and the pin 96*a* to the rear contact spring 58 in the battery case 52. As previously described, the rear contact spring 58 electrically contacts the negative terminal of the rearmost battery 54 of the power supply 15. Power from the power supply 15 is routed to the circuit 18 through the rear contact spring 58 and the electrical contact spring 50. The circuit 18 proceeds through the electrical contact spring 50, through the light bulb 44, the pin 96*b*, the contact 338*b*, the socket 336*b*, the prong 434*b*, the socket 436*b*, the prong 324*b*, the socket 326*b*, the prong 318*b*, the prong 320*b*, and the socket 310*b* to the terminal 312*b* of the switch 312.

As previously stated, the colored lens assembly 22 will remain in the closed position 24 unless manually opened or until activation of the solenoid 150. The switch 314 which controls the power to the solenoid 150 is normally off and in the normally open position 366. When in the depressed position 368, the switch 314 completes the circuit 75 by contacting the terminals 314*c* and *d*.

The circuit 75 proceeds from the terminal 314*c* through the socket 310*c*, the prong 320*c*, the prong 318*c*, the socket 326*c*, the prong 324*c*, the socket 436*c*, the prong 434*c*, the socket 336*c*, the contact 338*c*, and the pin 96*c* to the contact spring 71 in the battery case 60. The circuit 75 proceeds through the batteries 62 to the front contact 72 and then through the contact clips 156 to the solenoid 150. Passing through the solenoid 150, the circuit 75 then proceeds through the contact clips 157, the pin 96*d*, the contact 338*d*, the socket 336*d*, the prong 434*d*, the socket 436*d*, the prong 324*d*, the socket 326*d*, the prong 318*d*, the prong 320*d*, and the socket 310*d* to the terminal 314*d* of the switch 314.

That part of the switch 312 which controls the activation of the floodlight 12 may be completely bypassed by the bypass circuit 21. The microswitch 167 in the bypass circuit 21, has two positions. In the normally open position 370, the microswitch 167 activates nothing and the floodlight 12 is completely controlled by the switch 312. In the closed position 372, the microswitch 167 overrides the switch 312 and the rheostat 315 and activates the floodlight 12 at its brightest intensity. Moving the colored lens assembly 22 to an open position automatically moves the microswitch 167 to the closed position 372 to activate the floodlight 12.

The bypass circuit 21 proceeds from the rear contact spring 58 of the battery case 52 through the contact clips 179 to the microswitch 167. The bypass circuit 21 proceeds through the microswitch 167 when closed and then through the contact clips 181 to the contact 67 of the floodlight 12. The bypass circuit 21 then goes through the floodlight 12 to the electrical contact spring 50 which contacts the positive terminal of the forwardmost battery 54 in the battery case 52, as previously described.

When the various components of the luminous gun sighting system 10 are mounted to a rifle 41, a complete night or day hunting system is provided. After mounting the luminous gun sighting system 10 on the rifle 41, the hunter should adjust the sight means 30 by the adjustment means 38 and 40 to obtain more accurate sighting on the chosen firearm under the prevailing wind condition. As previously described, the adjustment means 38 and 40 may be operated in the home as well as in the field as conditions change.

Additional adjustments available to the hunter include the use of the rheostats 315 and 328 to vary the intensity of the brightness of the floodlight 12 and the LED 189 respectively, when the switches 312 and 314 are in the appropriate position. The rheostat 315 gives the hunter the ability to change the intensity of the floodlight 12 only when the red lens assembly 22 is in the closed position 24. When the colored lens assembly 22 is open, the microswitch 167 causes the bypass circuit 21 to bypass the circuit 18 and thereby render the operation of the rheostat 315 ineffective.

The rheostat 328 gives the hunter the ability to vary the intensity of the rear LED 189 in the rear sight 34 regardless of the position of the colored lens assembly 22. By adjusting the rheostat 328 the hunter may change the brightness of the LED 189 as he desires under varying levels of ambient light.

After the luminous gun sighting system 10 is assembled and mounted to a rifle 41, the hunter has a variety of operating modes from which to choose. In the presence of ample ambient light, the hunter may choose to leave the switch 312 in the null position 360 and use the unlit sighting means as he would the normal iron sights of a rifle 41. With plenty of ambient light, the hunter may also find it useful to activate the LED's 188 and 189 by moving the switch 312 to the sights-only position 362 or the hunter may choose to activate both the LED's 188 and 189 and the floodlight 12 by moving the switch 312 to the light-and-sights position 364. At any time, the hunter may activate the solenoid 150 by depressing the switch 314 to the closed position 368 thereby opening the colored lens assembly 22 and activating the floodlight 12 by means of the microswitch 167.

The luminous gun sighting system 10 will find its most useful operation under conditions of low or non-existent ambient light. A hunter stalking his prey will normally depend on the existing light to reflect back to him through the eyes of the hunted animal. If the existing light is so minimal as to preclude such natural reflection, the hunter can move the switch 312 to the light-and-sights position 364 thereby causing a red light to be emitted from the floodlight 12 through the colored lens 114 of the colored lens assembly 22. As previously stated, the colored lens 114 may be any color but it is well known to those skilled in the art that a red light will not be easily perceived by most hunted animals and therefore, for purposes of this description, the colored lens 114 shall be considered to be red. The hunter can then use the colored light emitted along the path 13 to help him spot the eyes of his prey.

Once the prey has been spotted with or without the aid of the red light emitted from the floodlight 12 through the lens 114, the hunter can put the switch 312 in the sights-only position 362 or the light-and-sights position 364 in order to illuminate the front and rear sights 32, 34 respectively. The red light emitted rearward from the sights 32 and 34 facilitates the retention of the hunter's night vision. The red light also allows the hunter to readily see the sights regardless of the ambient light conditions. If the hunter is using the luminous gun sighting system 10 with the switch in the sights-only position 362, he may sight in on his prey using the illuminated front and rear sights 32, 34 respectively, without the aid of the floodlight 12. However, if the hunter is using the luminous gun sighting system 10 with the switch 312 in the sights-only position 362, and he loses the eyes of his prey, he may flip the switch 312 into the light-and-sights position 364 by simply using his thumb without having to remove his hand from its position about the trigger 348 or his eye from the sights 32 and 34. The ease with which the hunter may activate the floodlight 12 with the switch 312 is not likely to attract the attention of the prey and scare it away, nor will it adversely affect his sighting process. With the aid of the red light emitted by the floodlight 12 through the lens 114, the hunter may again find his prey and sight in on it with the illuminated front and rear sights 32, 34 respectively.

At any time the hunter has the choice of depressing the pushbutton switch 314 thereby activating the solenoid 150 and opening the colored lens assembly 22 to allow the emission of a bright, clear light along the path 13 from the floodlight 12. As previously described, should the hunter be using the luminous gun sighting system 10 with the switch 312 in the null position 360 or the sights-only position 362 and desire to quickly activate the floodlight 12 to emit a bright, clear light, he need only press the switch 314 to the closed position 368. The opening of the colored lens assembly 22 from the closed position 24 automatically causes the microswitch 167 to go from the normally open position 370 to the closed position 372 thereby activating the floodlight 12 and the emission of a bright, clear light along the path 13. By including the microswitch 167 in the bypass circuit 21, the hunter using the luminous gun sighting system 10 in the null position 360 or the sights-only position 362, need not go to the light-and-sights position 364 before depressing the switch 314 to open the colored lens assembly to emit the bright, clear light from the floodlight 12 along the path 13. As previously described, the colored lens assembly 22 may also be opened from the closed position 24 by manual operation of the latch bar 139. This means of opening the colored lens assembly 22 likewise automatically moves the microswitch 167 from the normally open position 370 to the closed position 372 thereby activating the floodlight 12 and causing a bright, clear light to be emitted therefrom along the path 13.

An alternate design of a luminous gun sighting system of the present invention is indicated at 10' in FIGS. 18–23. The alternative embodiment of the luminous gun sighting system 10' provides an alternate method of mounting a luminous gun sighting system of the present invention on a firearm, such as a shotgun 42. It should be clearly understood that the luminous gun sighting system 10' may be mounted on any other kind of firearm including a rifle.

For ease of description, components of the gun sighting system 10' will be designated by the numbers designating their corresponding components in the gun sighting system 10 described above, followed by a prime mark suffix (').

Referring now more specifically to the drawings, and in particular FIG. 18, a luminous gun sighting system 10' embodying the alternate features of the present invention is shown for hunting nocturnal prey under conditions of low or non-existent ambient light as exist at night. The luminous gun sighting system 10' shown in FIG. 18 includes a light source or floodlight 12', a power supply 14', a circuit means 18' for selectively connecting and disconnecting the power supply and the light source, a lens assembly 20', and a means 68' for mounting the power supply to the firearm as previously provided in the preferred embodiment of the luminous gun sighting system 10.

The luminous gun sighting system 10' shown in FIG. 18 also includes a sight means 30' for sighting prey during both the day and night. The sight means 30' includes both a front and rear sight 32', 34' respectively, and a means 36' for selectively illuminating the front and rear sights. For ease of description, the sights 32' and 34' will be hereafter referred to as sight beads. In the alternate embodiment of the present invention shown in FIG. 18, the floodlight 12' is shown as it would appear when mounted with the power supply 14' on a conventional shotgun 42. It should be understood that it is within the contemplation of the alternate invention to provide a luminous gun sighting system as herein described on any other firearm.

As shown in FIGS. 19 and 20, the front sight bead 32' of the sight means 30' includes a body member 374, a light source 188', a 2-prong plug 376, a rubber gasket 378, and a means 191' for mounting the sighting bead to the barrel 90' of the shotgun 42.

The body member 374 of the sight bead 32' is preferably constructed of plastic or aluminum and has a front face 380, a top face 382, and side faces 384. The light source 188' is mounted in the top face 382 of the body member 374.

The light source 188' is a light emitting diode (LED), preferably red, but it should be understood that it is within the contemplation of this invention that any other available light sources known to those skilled in the art, such as commercial light bulbs or the like, may also be used. By using a red LED 188' the hunter enjoys the same advantages of not attracting the attention of his prey as previously described for the colored lens 114. The LED 188' is mounted in the body member 374 so as to be watertight and thereby exposable to any type of weather conditions in which the hunter may choose to use the luminous gun sighting system 10'. The LED 188' is located on the top face 382 of the body member 374 to make it readily visible to the hunter.

The 2-prong plug 376 is mounted in the front face 380 of the body member 374 so as to slideably interfit with a 2-hole socket 386 in the clamp 164'. The two prongs of the 2-prong plug 376 as well as the LED 188' are electrically connected in the circuit 76' as will be hereinafter more fully described.

The mounting means 191' of the front sight bead 32' includes mounting legs 388 (shown broken in FIG. 19 and complete in FIG. 20) which are hingeably attached to the side faces 84 of the body member 374. A mounting leg 388 has a head portion 390 which fits inside a recess 392 in a leg 166' as shown in FIG. 20. The rubber gasket 378 shown in FIGS. 19 and 20 is positioned between the body member 374 and the legs 166' to insure a watertight fit between the sight bead 32' and the clamp 164'. The gasket 378 is appropriately slotted to accommodate the 2-prong plug 376.

The front mounting clamp 164' is part of the mounting means 68' which serves both as a means for securing the power supply 14' to the shotgun 42 and as an electrical conduit for the circuit means 76'. The front mounting clamp 164' includes two identically shaped opposed sections or legs 166'. The legs 66' are shaped exactly like the legs 166 of the luminous gun sighting system 10 with a few alterations as will be hereinafter more fully described.

The alterations to the legs 166 of the front mounting clamp 64 of the system 10 include the 2-hole socket 386 and the two recesses 392 which are formed to accept the head sections 390 of the mounting legs 388 of the sight bead 32'. The 2-hole socket 386 is mounted to the legs 166' to accept the 2-prong plug 376 of the sight bead 32'. The sockets 386 are electrically connected in the circuit 76' as will be hereinafter more fully described.

Figure 21:
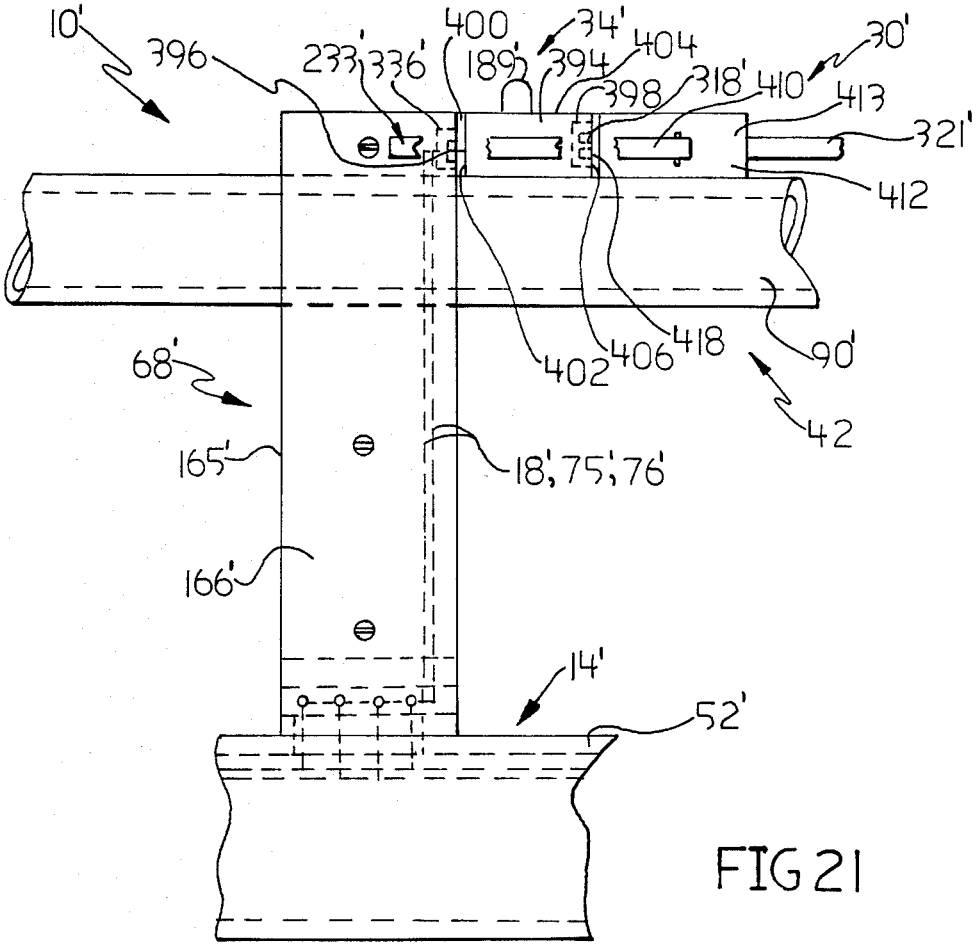
FIG. 21 is a partial, side elevational view of the floodlight and battery case assembly and the rear lighted gun sight mounted to the barrel of a shotgun shown in FIG. 18.
Figure 22:
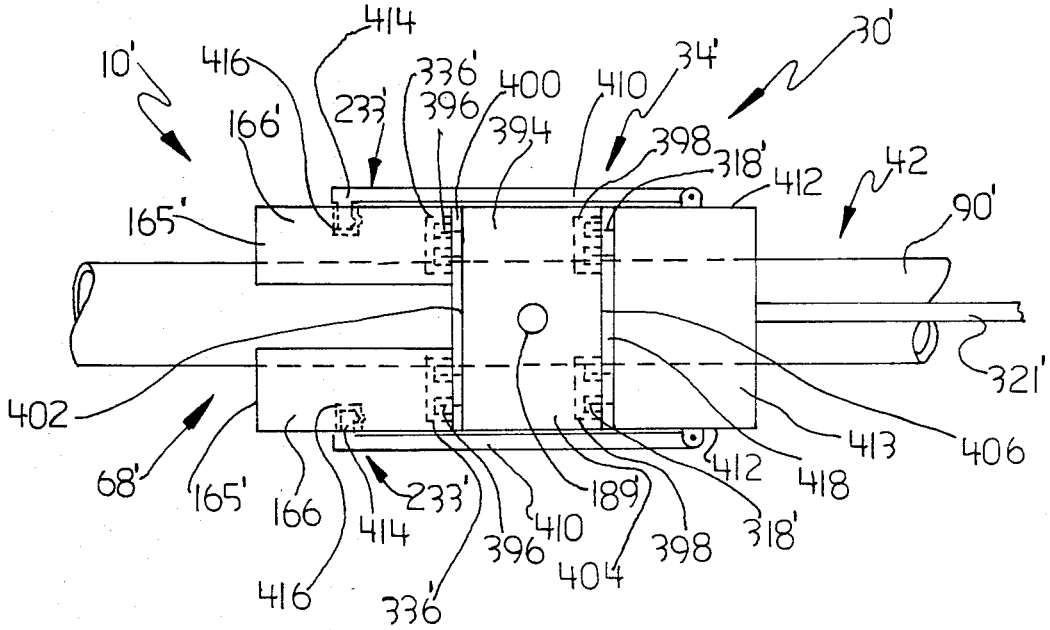
FIG. 22 is a top view of the rear lighted gun sight mounted to the barrel of a shotgun shown in FIG. 18.
Figure 23:
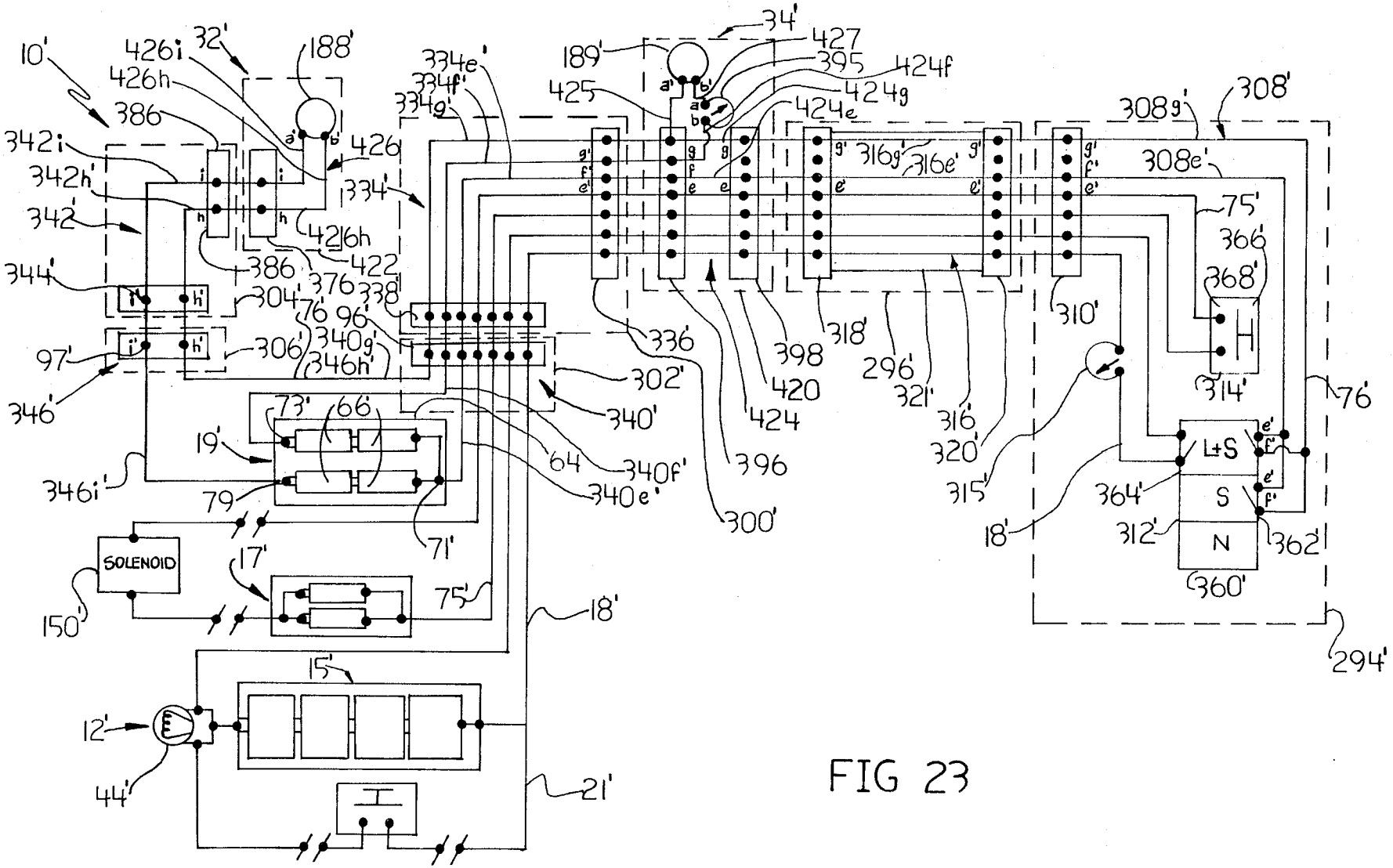
FIG. 23 is a schematic drawing illustrating the electrical circuitry of the embodiment of the present invention shown in FIG. 18.

As shown in FIGS. 21, 22, and 23, the rear sight bead 34' of the sight means 30' includes a body member 394, a light source 189', a rheostat 395, a 7-prong plug 396, a 7-hole socket 398, a rubber gasket 400, and a means 233' for mounting the sighting bead to the gun barrel 90' of the shotgun 42.

The body member 394 of the sight bead 34' is preferably constructed of plastic or aluminum and has a front face 402, a top face 404 and a rear face 406. The light source 189' is mounted in the top face 404 of the body member 394.

The light source 189' is a light emitting diode (LED), preferably red, but it should be understood that it is within the contemplation of this invention that any other available light sources known to those skilled in the art, such as commercial light bulbs or the like, may also be used. By using a red LED 189', the hunter enjoys the same advantages of not attracting the attention of his prey as previously described for the colored lens 114. The LED 189' is mounted in the body member 394 to be watertight and thereby exposable to any type of weather conditions in which the hunter may choose to use the luminous gun sighting system 10'. The LED 189' is located on the top face 404 of the body member 394 to make it readily visible to the hunter.

Shown schematically in FIG. 23, the rheostat 395 is conveniently mounted in tne body member 394. The 7-prong plug 396 shown in FIGS. 21 and 22 is mounted in the front face 402 of the body member 394 to slideably interfit with the 7-hole socket 336' in the clamp 165'. The 7-hole socket 398 is mounted in the rear face 406 of the body member 394 to slideably interfit with the 7-prong plug 318' on the conduit 321'. The seven prongs of the 7-prong plug 396, the LED 189', the rheostat 395, and the seven sockets of the 7-hole sockets 398 are electrically connected in the circuit 76' as will be hereinafter more fully described.

The mounting means 233' of the rear sight bead 34' includes mounting legs 410 (shown broken in FIG. 21 and complete in FIG. 22) which are hingeably attached to the side faces 412 of the body member 413 of the 7-prong plug 318'. A mounting leg 410 has a head portion 414 which fits inside a recess 416 in a leg 166' as shown in FIG. 22. The rubber gasket 400 shown in FIGS. 21 and 22 is positioned between the body member 394 and the legs 166' to provide a watertight fit between the sight bead 34' and the clamp 165'. The gasket 400 is appropriately slotted to accommodate the 7-prong plug 396. A rubber gasket 418 is positioned between the body members 394 and 413 to provide a watertight fit between the sight bead 34' and the plug 318'. The gasket 418 is appropriately slotted to accommodate the 7-prong plug 318'.

The rear mounting clamp 165' is part of the mounting means 68' which serves both as a means for securing the power supply 14' to the shotgun 42 and as an electrical conduit for the circuit means 76'. The rear mounting clamp 165' includes two identically shaped opposed sections or legs 166'. The legs 166' are shaped exactly like the legs 166 of the rear mounting clamp 165 of the system 10 with no alterations other than the two recesses 416 previoulsy described.

The circuit means 18', 75' and 76' which selectively connect and disconnect power to and from the floodlight 12', the solenoid 150' and the LED's 188', 189' respectively are designed in modules similar to those used in the luminous gun sighting system 10 as previously described. This modular design allows the gun sighting system 10' to be easily assembled and disassembled on an existing firearm and also allows for easy transfer of the luminous gun sighting system from one firearm to another. In addition, this modular design allows for simplified replacement of various components of the luminous gun sighting system 10' as will be hereinafter more fully described. It may be desirable to use different sight means for different types of firearms, for example rifles and shotguns. The modular design hereafter described allows for an easy modification of the circuitry to allow the use of different sight means 30'.

The modular design includes modules 294', 296', 420', 300', 302', 422', 304', and 306' indicated by dashed lines in FIG. 23. It should be understood that each module includes a bundle of wires interconnecting components at each end of that bundle of wires. The switch module 294', the rear conduit module 296', the rear power mounting clamp module 300', the rear power mounting bracket module 302', the front power mounting clamp module 304', and the front power mounting bracket module 306' include the same components, such as wiring bundles, plugs, sockets, and the like as previously described for the modules 294, 296, 300, 302, 304, and 306 of the luminous gun sighting system 10. As will be hereinafter more fully described, the switch module 294', the rear conduit module 296', and the front power mounting clamp module 304' are wired differently than their counterparts in the luminous gun sighting system 10.

The rear sight bead module 420 includes the wiring bundle 424 which interconnects the 7-hole socket 398, the 7-prong plug 396, the rheostat 395, and the LED 189'. The front power mounting clamp module 304' includes the wiring bundle 342' which interconnects a 2-point contact set 344' and a 2-hole socket 386. The front sight bead module 422 includes the wiring bundle 426 which interconnects a 2-prong plug 376 and the LED 188'.

The modules 294', 296', 420, 300', 302', 422, 304', and 306' are mounted to the shotgun 42 to allow for easy assembly and disassembly of the luminous gun sighting system 10' in the home or shop as well as in the field. The modules 294', 296', 420, 300', 302', 422, 304', and 306' are likewise located on the shotgun 42 to facilitate the use of the luminous gun sighting system 10' by the hunter.

The switch module 294', the rear conduit module 296', the rear power mounting clamp module 300', the rear power mounting bracket module 302', the front power mounting clamp module 304', and the front power mounting bracket module 306' are mounted to the shotgun 42 in the same general location on the shotgun as their counterparts are mounted on the rifle 41 as previously described for the luminous gun sighting system 10. It should be understood that it is within the contemplation of this invention to make the conduit 321' of the rear conduit module 296' the same length or a different length than its corresponding counterpart in the luminous gun sighting system 10.

The rear sight bead module 420 is mounted to the shotgun 42 as previously described for the rear sight bead 34' as shown in FIGS. 21, 22, and 23. The wiring bundle 424 of the rear sight bead module 420 is located inside the body member 394. The 7-hole socket 398 of the rear sight bead module 420 is mounted so as to slideably interfit with the 7-prong plug 318' of the rear conduit module 296'. The 7-prong plug 396 of the rear sight bead module 420 is mounted so as to slideably interfit the 7-hole socket 336' of the rear power mounting clamp module 300'. The LED 189' and the rheostat 395 of the rear sight bead module 420 are mounted in the rear sight bead 34' as previously described.

The front sight bead module 422 is mounted to the shotgun 42 as previously described for the front sight bead 32' as shown in FIGS. 19, 20, and 23. The wiring bundle 426 of the front sight bead module 422 is located inside the body member 374. The 2-prong plug 376 of the front sight bead module 422 is mounted to slideably interfit the 2-hole socket 386 of the front power mounting clamp module 304'. The LED 188' of the front sight bead module 422 is mounted in the front sight bead 32' as previously described.

The front power mounting clamp module 304' is mounted in the front mounting clamp 164' as shown in FIGS. 19, 20, and 23. The 2-point contact set 344' and the wiring bundle 342' of the front power mounting clamp module 304' are mounted to the legs 166' as previously described for their counterparts in the luminous gun sighting system 10. The 2-hole socket 386 of the front power mounting clamp module 304' is mounted to the top rear face of the clamp 164' to slideably interfit with the 2-prong plug 376 of the front sight bead module 422.

The circuit means 18', 75' and 76' interconnect the floodlight 12', the solenoid 150', and the LED's 188', 189' respectively with the switches 312' and 314' as seen in FIG. 23. The circuit described schematically in FIG. 23 is particularly designed for mounting the alternate gun sighting system 10' of the present invention on a shotgun 42. It should be understood that the alternate gun sighting system 10' may be mounted on any other firearm including a rifle 41.

The floodlight 12' is connected to the power supply 15' by means of the circuit 18', as previously described for the circuit 18 of the luminous gun sighting system 10. The solenoid 150' is electrically connected to the power supply 17' by means of the circuit 75' as previously described for the circuit 75 of the luminous gun sighting system 10. This is another example of the interchangeability feature of the components of the present and alternate invention.

The sight beads 188' and 189' are interconnected to the power supply 19' by means of the circuit 76' which provides for selective activation of the sight beads by means of the switch 312'. The rheostat 395 is provided to adjust the brightness of the rear sight bead 189' as will be hereinafter more fully described. The circuit 76' includes the wires 308*e'* and *g'* of the wiring bundle 308', the wires 316*e'* and *g'* of the wiring bundle 316', the wires 424*e*, *f*, and *g*, 425, and 427 of the wiring bundle 424, the wires 334*e'*, *f'*, and *g'* of the wiring bundle 334', the wires 340*e'*, *f'*, and *g'* of the wiring bundle 340', the wires 346*h'* and *i'* of the wiring bundle 346',the wires 342*h'* and *i* of the wiring bundle 342', and the wires 426*h* and *i* of the wiring bundle 426.

The wire 308*e'* electrically interconnects the terminal 312*e'* of the switch 312' and the socket 310*e'* of the 7-hole socket 310'. The wire 316e' interconnects the prong 320e' of the 7-prong plug 320' and the prong 318e' of the 7-prong plug 318'. The wire 424e interconnects the socket 396e of the 7-hole socket 396 and the prong 398e of the 7-hole socket 398. The wire 334e' electrically interconnects the socket 336e' of the 7-hole socket 336' and the contact 338e' of the 7-hole contact set 338'. The wire 340e' interconnects the pin 96e' of the seven pins 96' and the contact spring 71' of the battery case 64'. The contact spring 71' electrically interconnects the wire 340e' and the negative terminals of the rearmost batteries 66'.

The front contact 79' electrically interconnects the positive terminal of the forwardmost battery in one pair of the batteries 66' and the wire 346i'. The wire 346i' electrically interconnects the front contact 79' and the pin 97i' of the two pins 97'. The wire 342i electrically interconnects the contact 344i' of the 2-point contact set 344' and the socket 386i of the 2-hole socket 386. The wire 426i electrically interconnects the prong 376i of the 2-prong plug 376 and the terminal 188a' of the LED 188'.

The wire 426h interconnects the terminal 188b', of the LED 188'and the prong 376h of the 2-prong plug 376. The wire 342h' electrically interconnects the socket 386h of the 2-hole socket 386 and the contact 344h' of the 2-point contact set 344'. The wire 346h' interconnects the pin 97h' of the two pins 97' and the wire 340g' of the rear power mounting bracket module 302'. The wire 340g' connects the wire 346h' of the front power mounting bracket module 306' and the pin 96g' of the two pins 96'. The wire 334g' electrically interconnects the contact 338g' of the 7-point contact set 338' and the socket 336g' of the 7-hole socket 336'. The wires 425 and 424g electrically connect the prong 396g of the 7-prong plug 396 to both the LED 189' and that part of the circuit 76' between the prong 396g and the switch 312' as hereafter described.

The wire 425 electrically interconnects the prong 396g of the 7-prong plug 396 and the terminal 189a' of the LED 189'. The wire 427 interconnects the terminal 189b' of the LED 189' and the terminal 395a of the rheostat 395. The wire 424f electrically interconnects the terminal 395b of the rheostat 395 and the prong 396f of the 7-prong plug 396. The wire 334f' interconnects the socket 336f' of the 7-hole socket 336' and the contact 338f' of the 7-point contact set 338'. The wire 340f' interconnects the pin 96f' of the seven pins 96' and the front contact 73' of the battery case 64'.

That part of the circuit means 76' between the plug 396 and the switch 312' starts with the wire 424g. The wire 424g interconnects the prong 396g of the 7-prong plug 396 and the socket 398g of the 7-hole socket 398. The wire 316g' electrically interconnects the prong 318g' of the 7-prong plug 318' and the prong 320g' of the 7-prong plug 320'. The wire 308g' interconnects the socket 310g' of the 7-hole socket 310' and the terminal 312f' of the switch 312'. When the switch 312' is closed across the terminals 312e' and *f'*, the circuit 76' is completed as will be hereinafter more fully described.

As previously described, the circuit means 18', 75' and 76' which selectively connect and disconnect power to and from the floodlight 12', the solenoid 150' and the LED's 188', 189' respectively are operated by operation of the switches 312' and 314' of the switch module 294'. The switch 312' has three positions, 360', 362' and 364' as previously described for its counterpart 312 of the luminous gun sighting system 10 and the switch 314' has two positions, 366' and 368' as previously described for its counterpart 314 of the luminous gun sighting system 10.

In the null position 360', the switch 312' activates nothing and the luminous gun sighting system 10' is deactivated. In the sights-only position 362', the terminals 312e' and *f'* of the switch 312' are connected and the circuit 76' is completed. In this position, the hunter has the use of the front and rear sight beads 32', 34' respectively but not the floodlight 12'. It should be understood that the floodlight 12 may be activated by either manually or electrically opening the colored lens assembly 22', with the switch 312' in any of its three positions as will be hereinafter more fully described.

The circuit 76' proceeds from the terminal 312e' of the switch 312' through the socket 310e', the prong 320e', the prong 318e', the socket 398e, the prong 396e, the socket 336e', the contact 338e', and the pin 96e' to the contact spring 71' which contacts the negative terminals of the rearmost batteries 66' in the battery case 64'. The circuit 76' then passes through the batteries 66' to the front contacts 73' and 79' of the battery case 64'. From the contact 79', the circuit 76' proceeds through the pin 97i', the contact 344i', the socket 386i and the prong 376i to the LED 188'.

The circuit 76' then goes through the LED 188' to the prong 376h and then through the socket 386h, the contact 344h', the pin 97h', the pin 96g', the contact 338g', the socket 336g', to the prong 396g. That part of the circuit 76' proceeding from the prong 396g to the LED 189' and the power supply 19' will be described first followed by the description of that part of the circuit 76' proceeding from the prong 396g to the terminal 312f' of the switch 312.

The circuit 76' proceeds from the prong 396g through the LED 189' to the rheostat 395. As previously described, the rheostat 395 allows for the variance of the intensity of the brightness of the rear sight bead 34' by controlling the amount of current flowing to the LED 189'. The circuit 76' goes through the rheostat 395 to the prong 396f and then through the socket 336f', the contact 338f', and the pin 96f' to the front contact 73' of the battery case 64'. The other part of the circuit 76' between the prong 396g and the switch 312' proceeds from the prong 396g through the socket 398g, the prong 318g', the prong 320g', and the socket 310g' to the terminal 312f' of the switch 312'.

In the light-and-sights position 364', the switch 312' closes both the wiring circuits 18' and 76' thereby lighting the floodlight 12' and the LED's 188' and 189'. In this position 364', the circuit 76' operates as previously described for the switch position 362'. The circuit 18' proceeds through the components of the luminous gun sighting system 10' as previously described for its counterpart in the luminous gun sighting system 10.

The switch 314' which controls the power to the solenoid 150', controls the circuit 75' as previously described for its counterpart in the luminous gun sighting system 10.

The bypass circuit 21' bypasses that part of the switch 312' which controls the activation of the floodlight 12' as previously described for its counterpart in the luminous gun sighting system 10.

When the various components of the luminous gun sighting system 10' are mounted to a shotgun 42, a complete night or day hunting system is provided. After mounting the luminous gun sighting system 10' on the shotgun 42, the hunter should adjust the rheostats 315' and 395 to establish the desired intensity of the brightness of the floodlight 12' and the LED 189' respectively when the switches 312' and 314' are in the appropriate position. As previously described for its counterpart in the luminous gun sighting system 10, the rheostat 315' gives the hunter the ability to change the intensity of the floodlight 12' only when the red lens assembly 22' is closed. The rheostat 395 gives the hunter the ability to vary the intensity of the rear LED 189' in the rear sight bead 34' regardless of the position of the colored lens assembly 22'. By adjusting the rheostat 395, the hunter may change the brightness of the LED 189' as he desires under varying levels of ambient light.

After the luminous gun sighting system 10' is assembled and mounted to the shotgun 42, the hunter has a variety of operating modes from which to choose. The choices arising out of the luminous gun sighting system 10' available to the hunter are similar to those provided by the luminous gun sighting system 10 the only difference being the presence of the sighting beads 32' and 34' rather than the luminated sights 32 and 34 and the tube 186.

The luminous gun sighting systems 10 and 10' may be used in conjunction with any firearm including a rifle and shotgun as previously described. It is well-known to those skilled in the art that a hunter using a shotgun to hunt prey uses the sighting rib located on the top of the barrel of the shotgun to sight his prey. It is for this reason that the sighting beads described in the luminous gun sighting system 10' are preferably used on a shotgun rather than a rifle. In low or non-existent ambient light, the hunter using a shotgun with the luminous gun sighting system 10' mounted thereon is able to sight the shotgun by aligning the front and rear beads 32', 34' respectively. This alignment process is performed in conjunction with the use of the floodlight 12' in either the filtered or clear mode.

Having described my invention, I claim:

1. An apparatus for use on a rifle or shotgun for hunting prey at night in the absence of natural light, comprising:

(a) a source of light mounted to said rifle, said source emitting a beam of light having a diverse path such that said light beam is dispersed over a region in front of said firearm;

(b) a filter pivotally mounted to said light source and movable into and out of said beam path, said filter being operative to filter said light beam when in said beam path so that light in a spectrum substantially invisible to the prey being hunted is emitted over said region;

(c) actuation means for abruptly moving said filter out of said beam path to allow broad spectrum illumination of said region in front of said firearm, when desired;

(d) front and rear illuminated gun sights comprising a front gun sight defining front sighting structure illuminated from within by an integral light source and a rear gun sight defining rear sighting structure illuminated from within by an integral light source;

(e) means for adjusting the illumination intensity of at least one of said front and rear gun sights.

2. A gun sighting system for use with a conventional firearm for hunting nocturnal prey at night comprising:

(a) a light source mounted on the firearm for illuminating a region in front of said firearm in order to locate the prey being hunted, said light source emitting light in a spectrum substantially invisible to said prey;

(b) power supply means for providing power to said light source;

(c) said power supply means including a plurality of batteries positioned adjacent to and in contact with each other and having at least one shock absorber means to dampen gun recoil positioned between said batteries, said shock absorber means comprising a resilient elastomeric member having an inner opening, said resilient elastomeric member having one side in contact with one battery and another side in contact with another battery and a spring secured to said resilient elastomeric member and positioned in said inner opening of said resilient elastomeric member and in electrical contact with one end of one of said adjacent batteries and in electrical contact with the other end of the other of said adjacent batteries.

3. A luminous gun sighting system as described in claim 2 in which said light source has an opening for emitting light therefrom along a path and which includes circuit means for selectively connecting and disconnecting said power supply means and said light source and which includes a lens assembly positioned adjacent to said light emitting opening of said light source, said lens assembly having a colored lens movable between a closed position in which said colored lens is positioned across the path of light emitted from said light source and an open position in which said colored lens is clear of the path of light emitting from said light source.

4. A luminous gun sighting system as described in claim 2 which includes sight means mounted on the firearm, said sight means having a front gun sight and a rear gun sight and means for selectively illuminating at least one of said front and said rear gun sights.

5. A luminous gun sighting system as described in claim 4 which includes means for mounting said front and said rear gun sights on the firearm, said mounting means including means for adjusting the relative positions of said front and said rear gun sights with respect to each other when mounted on the firearm.

6. A luminous gun sighting system as described in claim 4 in which said circuit means includes means for selectively disconnecting said power supply means from said light source and said means for illuminating said one gun sight in a first position and for selectively connecting said power supply to said means for illuminating said one gun sight in a second position and for selectively connecting said power supply to said means for illuminating said one gun sight and said light source in a third position.

7. A luminous gun sighting system for use with a conventional firearm for hunting nocturnal prey comprising:

a. a front gun sight having an upper portion of clear light transmitting material, a light emitting diode mounted in said upper portion of said front gun sight, said front gun sight having a pair of contact pins extending therefrom, said contact pins electrically connected to said light emitting diode;

b. a rear gun sight having an upper portion of clear light transmitting material, a light emitting diode mounted in said upper portion of said rear gun sight, said rear gun sight having a pair of contact pins extending therefrom, said contact pins electrically connected to said light emitting diode;

c. means for mounting said front and said rear gun sights on the conventional firearm, said mounting means including receptacles for receiving and electrically contacting said pairs of contact pins of said front and rear sights and means for adjusting the relative positions of said front and said rear gun sights with respect to each other when mounted on the firearm; and d. means for selectively illuminating said front gun sight and said rear gun sight including a power supply means and a circuit means for selectively connecting and disconnecting said power supply means to said receptacles.

8. A luminous gun sighting system as described in claim 7 in which at least one of said front and said rear gun sights has a front face, a rear face, and a pair of opposing side faces, said front and said opposing side faces having a means for resisting the passage of light therethrough while allowing light to pass through said rear face.

9. A luminous gun sighting system as described in claim 7 which includes:

a. a second light source mounted on the firearm, said light source having an opening for emitting light therefrom along a path;

b. power supply means for providing power to said second light source;

c. circuit means for selectively connecting and disconnecting said power supply means and said second light source; and d. a lens assembly positioned adjacent to said light emitting opening of said second light source, said lens assembly having a colored lens movable between a closed position in which said colored lens is positioned across the path of light emitted from said second light source and an open position in which said colored lens is clear of the path of light emitting from said second light source.

10. A luminous gun sighting system as described in claim 7 in which said power supply means includes a battery case and a plurality of batteries located in said battery case, and at least one shock absorber positioned between adjacent batteries for protecting the said adjacent batteries from recoil forces when the firearm is discharged.

11. A luminous gun sighting system described in claim 7 in which said circuit means includes means for adjusting the amount of illumination of said rear gun sight.

12. A luminous gun sighting system as described in claim 7 including a light source mounted on the firearm, said light source having an opening for emitting light therefrom along a path, said circuit means including means for selectively disconnecting said power supply means from said light source and said means for illuminating said one gun sight in a first position and for selectively connecting said power supply to said means for illuminating said one gun sight in a second position and for selectively connecting said power supply to said means for illuminating said one gun sight and said light source in a third position.

13. A gun sighting system for use with a conventional firearm for hunting nocturnal prey at night in the absence of natural light, comprising:

(a) a light source mounted on the firearm, said light source having an opening for emitting light over a region in front of said firearm;

(b) power supply means for providing power to said light source;

(c) switch means for selectively connecting and disconnecting said power supply means and said light source;

(d) a lens assembly including a filter for filtering the light source to provide light within a light spectrum substantially invisible to the prey, over said region, said filter being movable between a closed position in which said filter is positioned across the opening of said light source such that light emitted by said light source is filtered by said filter, and an open position in which said filter is spaced from said opening of said light source;

(e) remote actuating means for moving said filter between said opened and closed position; and, (f) a self-illuminated sight means mounted on the firearm including a front gun and a rear gun sight each having an integral light source for providing self-illumination, and means for adjusting an illuminating intensity of at least one of said front and rear gun sights.

14. A gun sighting system as described in claim 13 in which said power supply means includes a battery case and a plurality of batteries located in said battery case, and at least one shock absorber positioned between adjacent batteries for protecting the said adjacent batteries from recoil forces when the firearm is discharged.

15. A gun sighting system as claimed in claim 13 wherein said remote actuating means for said filter comprises:

(a) a solenoid connected to said filter; and, (b) means for selectively energizing and de-energizing said solenoid.

16. A gun sighting system as claimed in claim 13 in which said sight means includes a tubular member on which said front gun sight and said rear gun sight are mounted and at least one of said front and rear gun sights being constructed of light transmitting material and having said integral light source positioned inside of said light transmitting material.

17. A gun sighting system as described in claim 16 in which said sight means includes means for adjusting the position of at least one of said front and rear sights to allow for accurate sighting of the firearm.

18. The apparatus of claim 16 wherein the light sources for said front and rear gun sights at least partially define said front and rear sighting structure.

* * * * *